US005983042A

United States Patent [19]

Nagata et al.

[11] Patent Number: 5,983,042

[45] Date of Patent: Nov. 9, 1999

[54] COLOR IMAGE FORMING APPARATUS HAVING A PRINTING MECHANISM SELECTIVELY MOVABLE TO OPERATIVE AND NON-OPERATIVE POSITIONS

[75] Inventors: Masato Nagata; Hisao Ono; Yoshiharu Momiyama; Noboru Otaki; Atsushi Kurabayashi; Shinichi Murakami; Yoshitatsu Okiyama; Mikio Yamamoto; Shigeki Nakajima; Masato Sakai; Fumiaki Yoshida; Norio Ebata; Makoto Yabuki; Makoto Otake, all of Tokyo, Japan

[73] Assignee: Oki Data Corporation, Tokyo, Japan

[21] Appl. No.: 08/954,733

[22] Filed: Oct. 20, 1997

[30] Foreign Application Priority Data

| | | | |
|---|---|---|---|
| Oct. 21, 1996 | [JP] | Japan | 8-278397 |
| Oct. 21, 1996 | [JP] | Japan | 8-278399 |
| Nov. 20, 1996 | [JP] | Japan | 8-324598 |

[51] Int. Cl.[6] ..... G03G 15/00

[52] U.S. Cl. ..... 399/45; 347/115; 399/67; 399/228; 399/298; 399/299

[58] Field of Search ..... 399/45, 223, 67–69, 399/228, 231, 234, 298, 299, 300, 303; 382/162; 358/515; 347/115

[56] References Cited

U.S. PATENT DOCUMENTS

| | | | |
|---|---|---|---|
| 4,711,172 | 12/1987 | Capdebosc | 101/152 |
| 5,237,645 | 8/1993 | Nagata et al. | 395/115 |
| 5,282,012 | 1/1994 | Terada et al. | 399/299 X |
| 5,303,018 | 4/1994 | Terada et al. | 399/299 |
| 5,365,324 | 11/1994 | Gu et al. | 399/299 |
| 5,541,634 | 7/1996 | Otsuka et al. | 399/299 X |

*Primary Examiner*—William Royer
*Attorney, Agent, or Firm*—Rabin & Champagne, P.C.

[57] ABSTRACT

A color image forming apparatus provides the prolonged life of the photosensitive drums, carrier belt, and toner of the respective colors and improves the quality of the printed color image. A carrier belt transports a recording medium placed thereon so that the recording medium passes through a plurality of printing mechanisms which print images of different colors on the recording medium in superposition. Each printing mechanism prints an image of a corresponding color. The printing mechanism is adapted to be moved into its operative position where the photosensitive drum of the printing mechanism is in contact with the carrier belt to print the image on the recording medium, and into its non-operative position where the photosensitive drum of the printing mechanism is not in contact with the carrier belt. A controller receives print data from a host device such as a personal computer and checks each page of the print data to determine whether any one of a predetermined plurality of colors is missing in the page. If a particular color is missing in the print data, then the controller outputs an UP signal to a positioning mechanism for a corresponding printing mechanism. If the color is not missing, then the controller outputs a DOWN signal. The printing mechanism moves a corresponding printing mechanism into the operative position if the UP signal is received from the controller and into its operative position if the DOWN signal is received.

12 Claims, 17 Drawing Sheets

COLOR IMAGE FORMING APPARATUS HAVING A PRINTING MECHANISM SELECTIVELY MOVABLE TO OPERATIVE AND NON-OPERATIVE POSITIONS

FIELD OF THE INVENTION

The present invention relates to a color image forming apparatus.

DESCRIPTION OF THE RELATED ART

A conventional color image forming apparatus includes printing mechanisms for yellow, magenta, cyan, and black. The printing mechanisms are each provided with a recording head having recording elements arranged in line. The recording head produces a toner image of a corresponding color on a line-by-line basis, yellow, magenta, cyan, or black. A recording medium is fed from a paper cassette one sheet at a time. The recording medium is then attracted to a carrier belt and travels in a direction perpendicular to a direction in which the recording elements are aligned. The recording medium passes through the respective printing mechanisms so that toner images of the respective colors are successively transferred to the recording medium, one image being superimposed over the others.

With the aforementioned conventional color image forming apparatus, all of the printing mechanisms are operated even when only an image of a particular color is to be produced and the carrier belt is simultaneously in contact with the photosensitive drums of the respective printing mechanisms. Thus, the photosensitive drums and carrier belt are subjected to rapid wear and tear.

Such a construction causes rapid deterioration of the toner of the respective colors, shortening the useful life of the toner and decreasing the quality of the printed image.

SUMMARY OF THE INVENTION

The present invention was made in view of the aforementioned drawbacks of the prior art image forming apparatus. An object of the present invention is to provide a color image forming apparatus which provides prolonged life of the photosensitive drums, carrier belt, and toner of the respective colors and improves the quality of the printed color image.

A carrier belt transports a recording medium placed thereon so that the recording medium passes through a plurality of printing mechanisms which print images of different colors on the recording medium in superposition. Each printing mechanism prints an image of a corresponding color. The printing mechanism is adapted to be moved into its operative position where the photosensitive drum of the printing mechanism is in contact with the carrier belt to print the image on the recording medium, and into its non-operative position where the photosensitive drum of the printing mechanism is not in contact with the carrier belt. A controller receives print data from a host device such as a personal computer and checks each page of the print data to determine whether any one of a predetermined plurality of colors is missing in the page. If a particular color is missing in the print data, then the controller outputs an UP signal to a positioning mechanism for a corresponding printing mechanism. If the color is not missing, then the controller outputs a DOWN signal. The printing mechanism moves a corresponding printing mechanism into the operative position if the UP signal is received from the controller and into its operative position if the DOWN signal is received.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The preferred embodiments of the invention will be described with reference to the accompanying drawings.

First Embodiment

<Generating UP/DOWN Signals>

Figure 1:
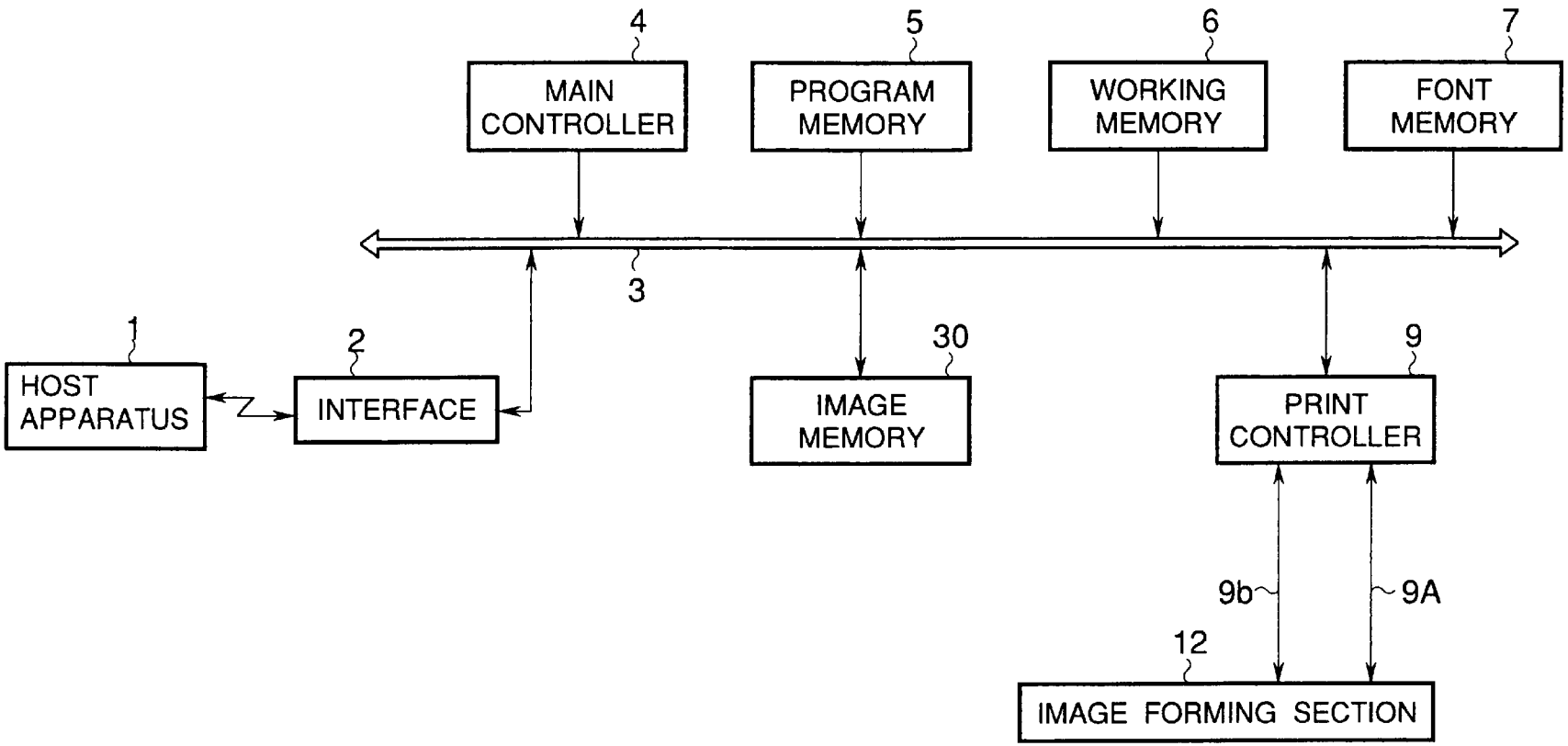
FIG. 1 is a block diagram of an image forming apparatus.

FIG. 1 is a block diagram of an image forming apparatus.

Referring to FIG. 1, the image forming apparatus receives print data 60 from a host apparatus 1 via an interface 2 and performs a printing operation in accordance with the print data 60. A main controller 4, program memory 5, working memory 6, font memory 7, and image memory 30 are connected to each other via a system bus 3. The print controller 9 receives image data 9A from the image memory 30 and sends it to an image forming section 12.

The main controller 4 controls the overall operation of the image forming apparatus under the control of a program stored in the program memory 5. The working memory 6 stores various parameters and other data necessary for the main controller 4 to operate. The font memory 7 stores data required for converting character codes contained in the print data into bit map data. The image memory 30 stores image data 60 that has been converted from the print data received from the host apparatus 1.

Figure 2:
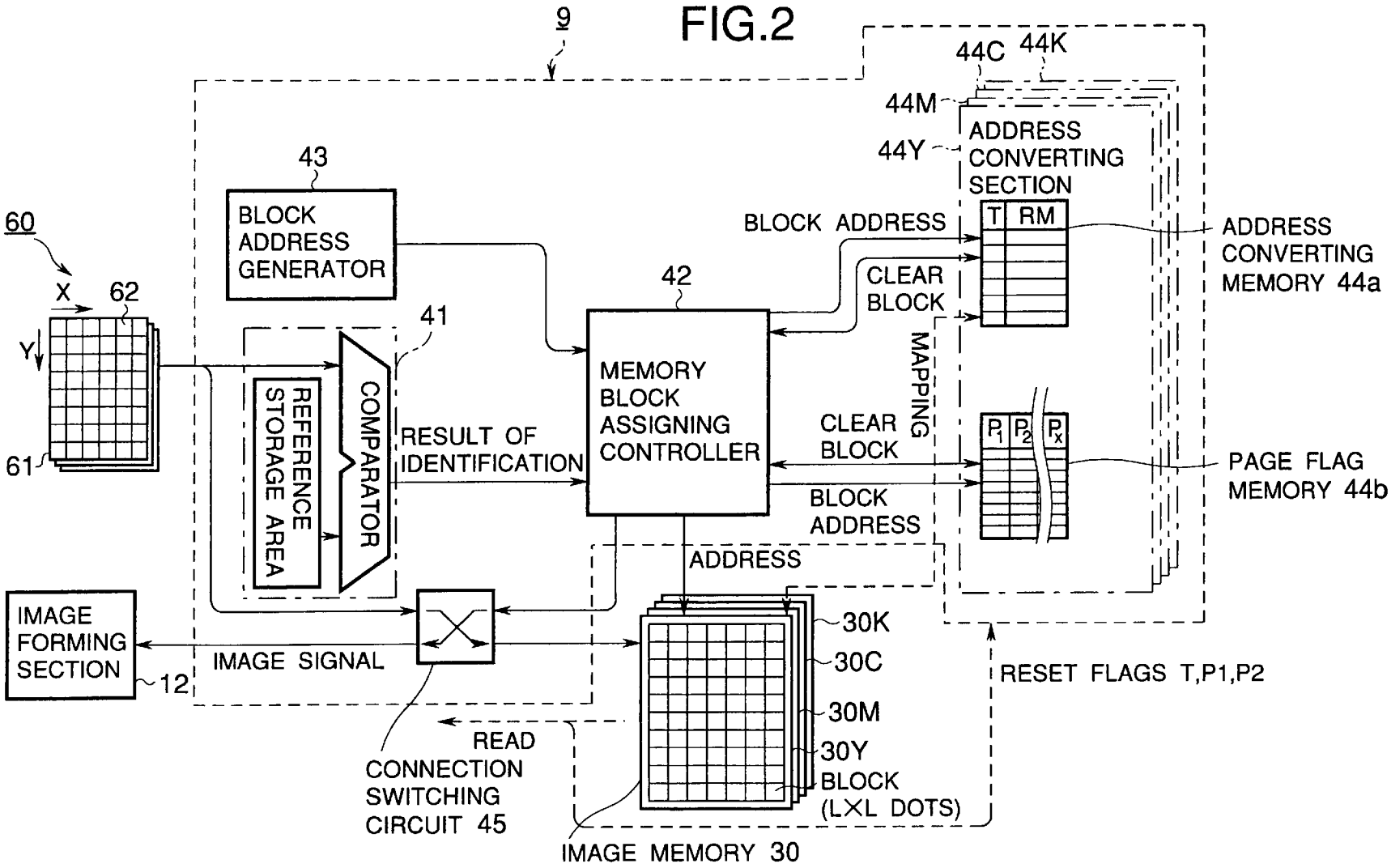
FIG. 2 is a block diagram illustrating the print controller.

FIG. 2 is a block diagram illustrating the print controller 9.

In this embodiment, each page of the print data 60 received from the host apparatus 1 is referred to as a virtual page 61. The virtual page 61 is divided into a plurality of blocks 62 of an arbitrary size. In the specification, the term "empty block" is used to cover a block in which no image information is contained and the term "non-empty block" to cover a block in which image information is contained. These blocks are sent to a block identifying section 41 where a comparator 41*b* compares the content in each block 62 with a reference value stored in the reference storage area 41*a*. The reference value is zero, representing an empty block. If the content in the block 62 does not coincide with the reference value, the block 62 is a non-empty block.

The block address generator 43 is an address counter that generates the addresses of the blocks (i.e., block address) 62 in the virtual page 61 when reading the blocks 62 from the virtual page 61..

The memory block assigning controller 42 receives the comparison results from the block identifying section 41 and then accesses, using the block addresses, the address converting sections 44Y, 44M, 44C, and 44K for yellow, magenta, cyan, and black, respectively, to write mapping information for an image of each color in the virtual page 61. Each address converting section includes an address converting memory 44*a* and page flag memory 44*b*. The address converting memory 44*a* takes the form of a data table which lists mapping flags T for all blocks 62 and addresses RM in the image memory 30 into which the contents of the non-empty blocks are stored. If a block 62 is an empty block, no data is written into the image memory 30. Therefore, the corresponding address RM in the address converting memory 44*a* is left blank. The page flag memory 44*b* takes the form of a data table which lists page flag P indicative of the virtual page 61 to which the content of each non-empty block stored in the image memory 30 belongs. The image memory 30 includes four different storage areas; storage areas 30Y for yellow, 30M for magenta, 30C for cyan, and 30K for black. Each storage area has a capacity for one virtual page. However, a virtual page usually contains empty blocks and non-empty blocks and therefore each storage area in the image memory can store the contents of non-empty blocks for more than one virtual page. The memory block controller 42 controls a switch circuit 45 to direct the blocks 62 to the image memory 30 and to direct the content of the image memory 30 to the image forming section 12. When all the blocks 62 are empty blocks, the memory block assigning controller 42 controls the switch circuit 45 not to direct the blocks 62 to the image memory 30. When some of the blocks 62 are non-empty blocks, the memory block assigning controller 42 directs the blocks 62 to the image memory 30 via the switch circuit 45.

<Writing Data into Address Converting Section>

Figure 3:
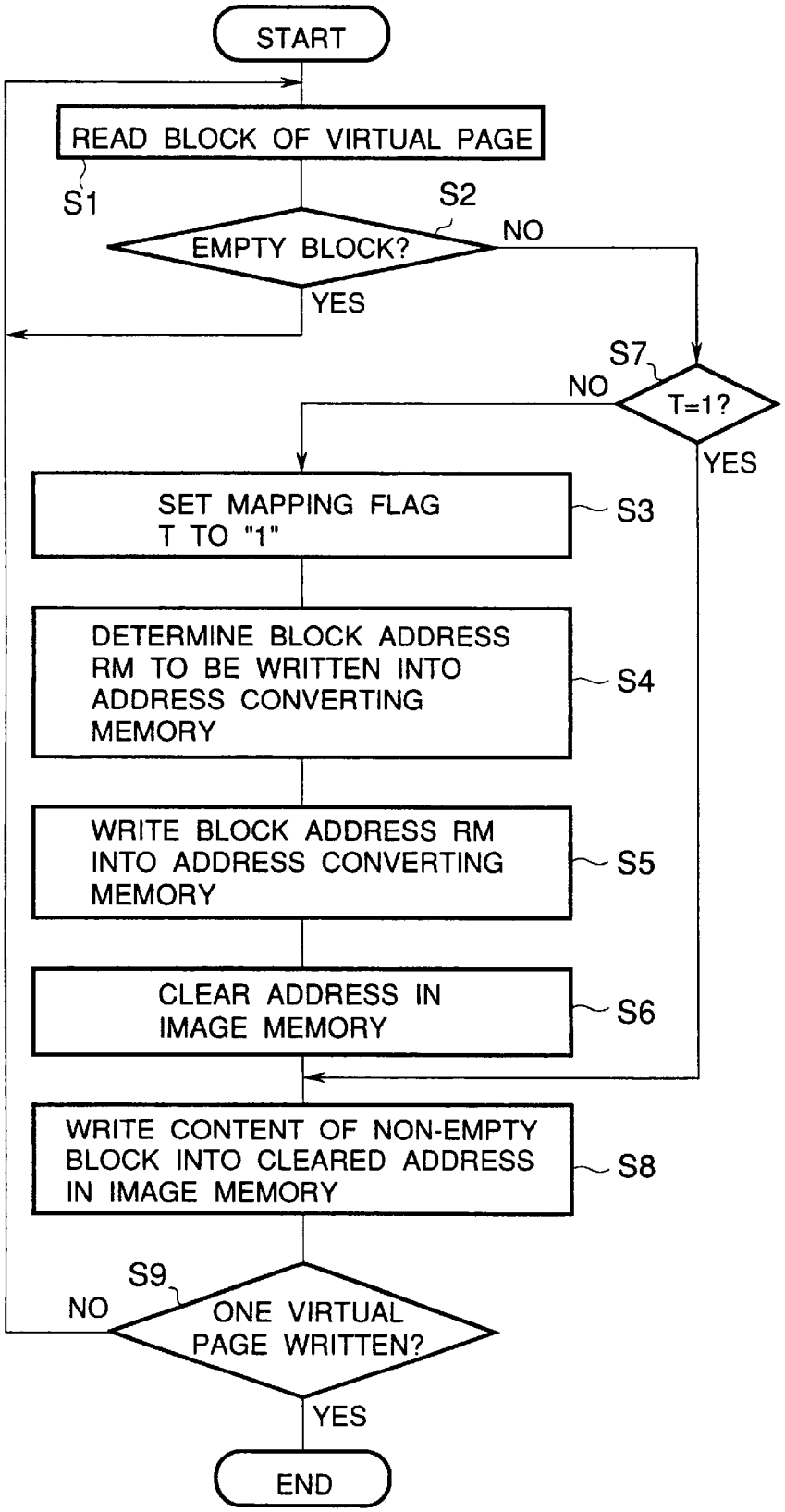
FIG. 3 is a flowchart illustrating the operation of writing the mapping information into the address converting section.

FIG. 3 is a flowchart illustrating the operation of writing the mapping information into the address converting section 44.

The steps in FIG. 3 are repeatedly performed for a plurality of virtual pages and therefore information is overwritten every time information for a new virtual page is written. The following description assumes the operation of writing the mapping information for the current virtual page when the address converting section holds the mapping information of the preceding virtual page. At step S1 in FIG. 3, a block 62 of the virtual page 61 is read out and a check is made at step S2 to determine whether the block 62 is an empty block. If YES, the program returns to step S1 where the next block 62 is read out. If the answer is NO, it is implied that the block 62 is a non-empty block. That is, the block 62 contains some amount of image information and therefore the program proceeds to step S7 where a check is made to determine whether the mapping flag T for the block of the preceding virtual page stored in the address-converting memory 44*a* is "1". If the answer is YES at step S7, the program jumps to step S8 and if the answer at step S7 is NO, the program proceeds to step S3 where the mapping flag T is set to "1". Then, at step S4, the program determines a block address RM in the image memory 30 into which the content or the non-empty block should be written.

At step S5, the address RM of the image memory 30 is written into the address converting memory 44*a*.

At step S6, the block address of the image memory 30 into which the content of the non-empty block is to be written is cleared. Then, the program proceeds to step S8 where the content of the non-empty block determined at step S5 is written into the corresponding block address of the image memory 30 which is just cleared. The page flag is written into the page flag memory 44*b*.

At step S9, a check is made to determine whether data for one virtual page has been completely processed. If the answer is NO, the program returns to step S1. In this manner, for each virtual page, the program writes the mapping information into the address converting memory 44*a* and the page flag memory 44*b*, and the writing image data into the image memory 30.

Upon completion of data mapping of the print data 60, the mapped data is read out from the image memory 30 for actual printing operation. Prior to the printing operation, the UP/DOWN operations of the printing mechanisms are performed. In the UP operation, a printing mechanism is raised from the carrier belt if the virtual page contains no non-empty block at all for the printing mechanism. In the UP operation, a printing mechanism is lowered onto the carrier belt if the virtual page contains at least one non-empty block for the printing mechanism.

<UP/DOWN operations>

Figure 4:
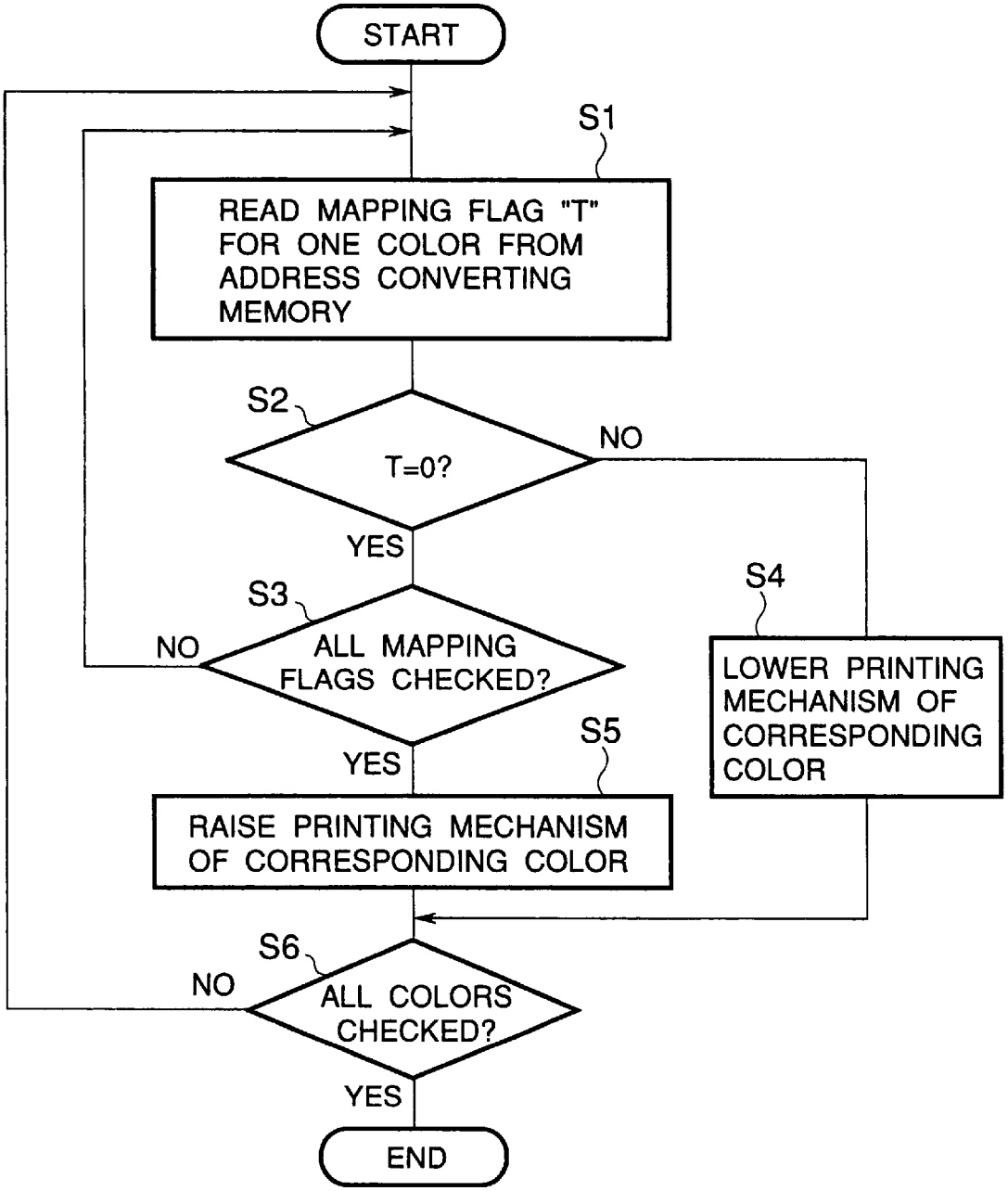
FIG. 4 is a flowchart illustrating the UP/DOWN operations.

FIG. 4 is a flowchart illustrating the UP/DOWN operations where later described printing mechanisms are lowered to their operative positions when printing and raised to their non-operative positions when not printing. The UP/DOWN operations are performed in accordance with the condition of the mapping flag T.

At step S1, the address converting memory 44*a* is referred to read the mapping flag T of a block of one of yellow, magenta, cyan, and black.

At step S2, a check is made to determine whether the mapping flag T is "0". If the mapping flag T is "0", then the program returns via step S3 to step S1 for checking the next mapping flag T of the same color. If the mapping flag T is not "0" at step S2, the program proceeds to step S4 where a printing mechanism of a corresponding color is lowered to its operative position for printing. Thus, if an image of each color contains at least one non-empty block, then a DOWN signal is outputted so that a corresponding printing mechanism is lowered to its operative position.

At step S3, a check is made to determine whether blocks in one virtual page have been checked for yellow, magenta, cyan, and black. If the answer is NO at step S3, the program proceeds to step S1 to repeat steps S1–S4 for the next color. If the answer is YES at step S3, the program ends. If the answer is YES at step S3, then the program proceeds to step S5 where an UP signal is outputted so that a corresponding printing mechanism is raised to its non-operative position.

In this manner, the blocks 62 for an image of each color in one virtual page 61 are checked to determine whether the block 62 is a non-empty block (T=1) or an empty block (T=1).

Then, a check is made to determine whether mapping flags T for all colors have been checked. If the answer at step S6 is NO, the program jumps to step S1 for checking mapping flags T for the next color. If the answer at step S6 is NO, the UP/DOWN operation completes.

After having checked all the mapping flags T, the image forming apparatus performs a printing operation.

The aforementioned steps S1–S6 are repeated for the next virtual page every time one virtual page has been printed till all the virtual pages have been printed.

<Construction of Image Forming Apparatus>

Figure 5:
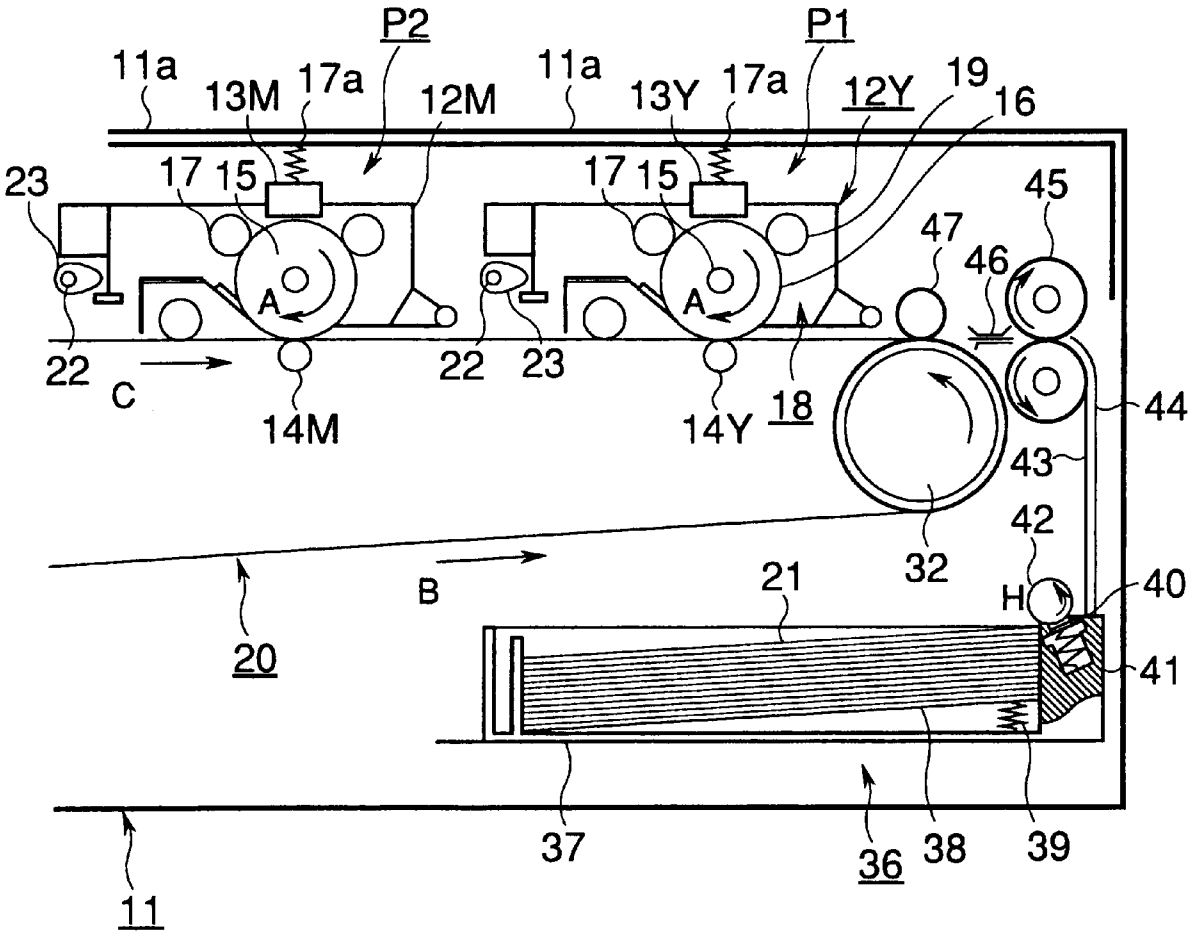
FIGS. 5 and 6 illustrate a construction of a color image forming apparatus including a plurality of printing mechanisms which are controlled by a mapping flag.
Figure 6:
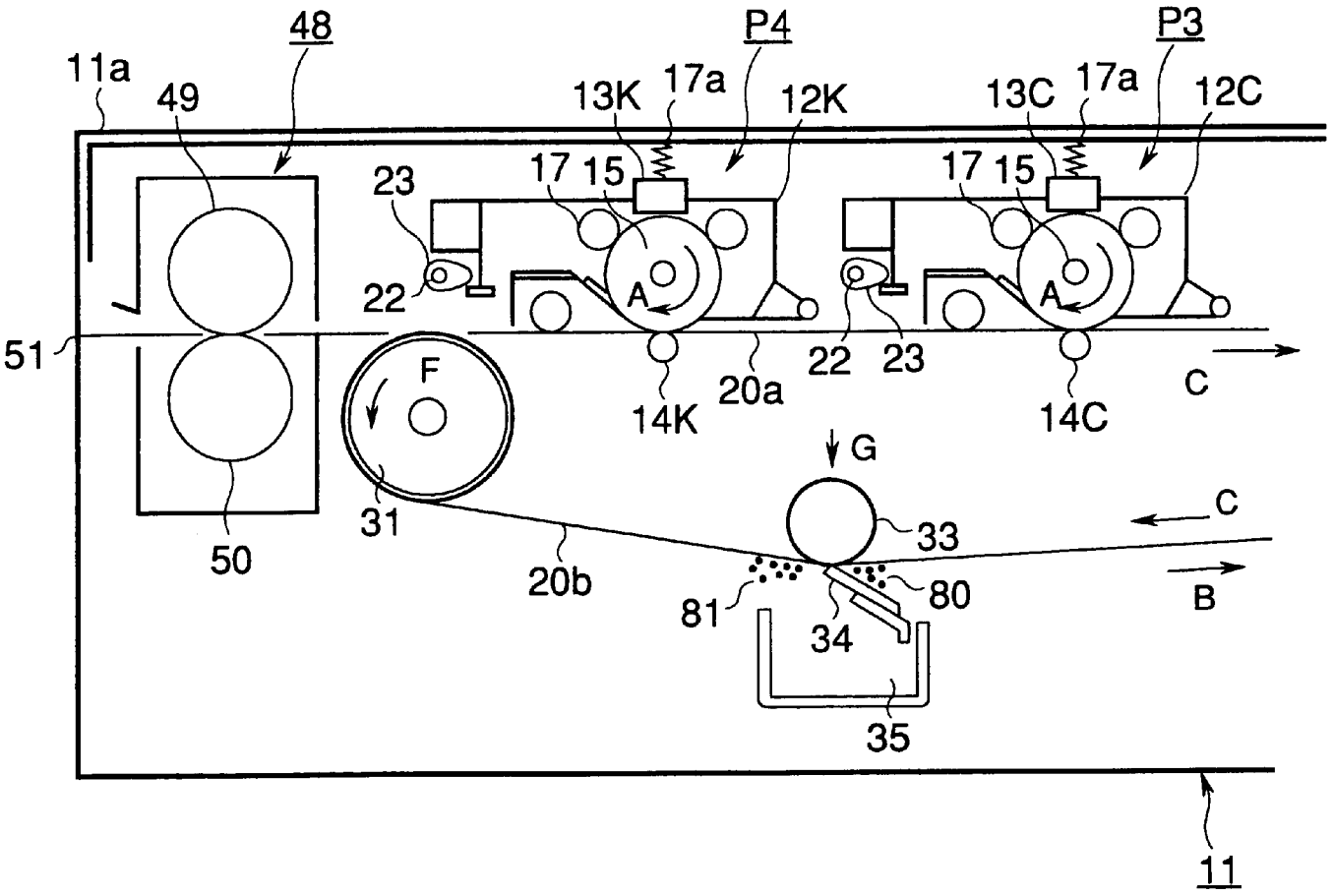

FIGS. 5 and 6 illustrate a construction of a color image forming apparatus including a plurality of printing mechanisms which are controlled by the mapping flag T.

Referring to FIGS. 5 and 6, a color image forming apparatus 11 includes first to fourth printing mechanisms P1–P4, arranged in tandem along the path of a recording medium 21. The first to fourth printing mechanisms P1–P4 are electrophotographic LED type printing mechanisms. The first printing mechanism P1 includes a printing mechanism 12Y for yellow, LED head 13Y which illuminates a surface of a photosensitive drum 16, transfer roller 14Y which transfers a yellow toner image formed in the printing mechanism 12Y to a recording medium 21.

The second printing mechanism P2 includes a printing mechanism 12M for magenta, LED head 13M which illuminates a surface of a photosensitive drum 16, and transfer roller 14M which transfers a magenta toner image formed in the printing mechanism 12M to the recording medium 21.

The third printing mechanism P3 includes a printing mechanism 12C for cyan, LED head 13C which illuminates a surface of a photosensitive drum 16, and transfer roller 14C which transfers a cyan toner image formed in the printing mechanism 12C to the recording medium 21.

The fourth printing mechanism P4 includes a printing mechanism 12K for black, LED head 13K which illuminates a surface of a photosensitive drum 16, and transfer roller 14K which transfers a black toner image formed in the printing mechanism 12K to the recording medium 21.

The printing mechanisms 12Y, 12M, 12C, and 12K are of the same construction. The respective printing mechanism includes the photosensitive drum 16 rotated on a shaft 15 in a direction shown by arrow A, a charging roller 17 for uniformly charging the surface of the photosensitive drum 16, and a developing unit 18. The developing unit 18 primarily includes a developing roller 19 and a toner tank, not shown.

The LED heads 13Y, 13M, 13C, and 13K will now be described.

The LED head primarily includes an LED array, drive ICs for driving the LED array, a circuit board on which the drive ICs are mounted, and a rod lens array for converging light emitted from the LED array, all being not shown. Each LED head receives an image signal of a corresponding color from the image memory 30 and illuminates the surface of the photosensitive drum 16 in accordance with the image signal to form an electrostatic latent image thereon. The electrostatic latent image attracts toner with the aid of Coulomb force, being developed with the toner into a toner image of a corresponding color.

The LED heads 13Y, 13M, 13C, and 13K are urged downwardly by springs **17*a* towards and against an upper part of a frame 24. An endless type belt 20 runs through transferring areas defined between the photosensitive drums 16 of the printing mechanisms 12Y, 12M, 12C,, and 12K and the transfer rollers 14Y, 14M, 14C, and 14K**.

The developing units 18 of the printing mechanisms 12Y, 12M, 12C, and 12K hold yellow toner, magenta toner, cyan toner, and black toner, respectively.

The LED heads 13Y, 13M, 13C, and 13K of the first to fourth printing mechanisms P1–P4 receive image signals of yellow, magenta, cyan, and black, respectively.

The UP/DOWN operations of the printing mechanism will be described.

Figure 7:
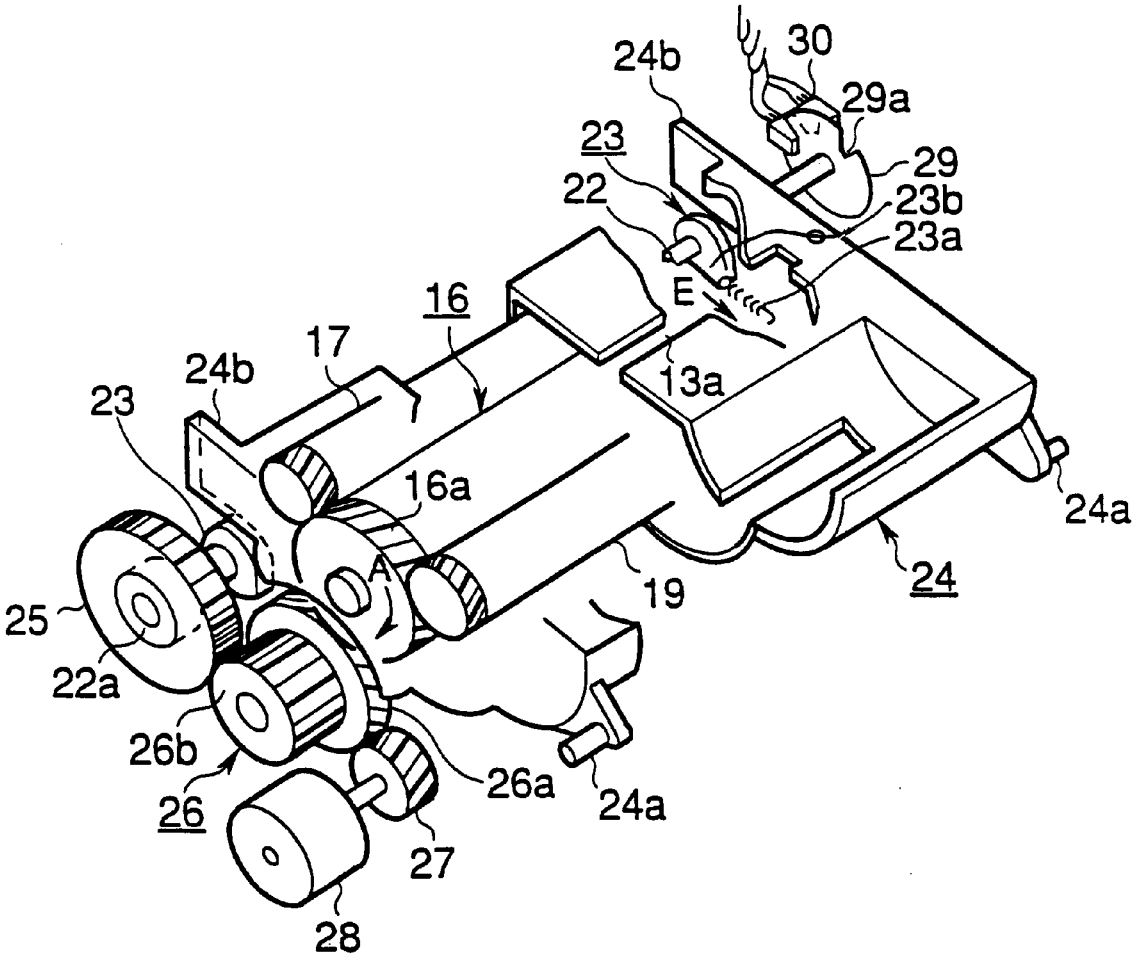
FIG. 7 is a perspective view of, for example, a printing mechanism, by way of example, when positioned at its operative position.

FIG. 7 is a perspective view of, for example, the printing mechanism 12Y when positioned at its operative position.

The frame 24 is formed with projections **24*a* at the upstream end with respect to the direction of travel of the recording medium 21 and projections 24*b* at the downstream end. The projections 24*a* are rotatably received in guiding grooves, not shown, formed in the main body of the color image forming apparatus 11**.

Cam shaft 22 is located downstream of the printing mechanism 12Y with respect to the direction of travel of the recording medium 21, and is rotatably supported by the main body of the color image forming apparatus 11. Eccentric cams 23 are provided at longitudinal ends of the cam shaft 22 to oppose the projections **24*b***.

The spring **17*a* urges the frame 24 downwardly via the LED head 13Y. When the cam shaft 22 is rotated, the eccentric cams 23 rotate while gradually pushing up the projections 24*b* against the urging forces applied by the spring 17*a***.

The LED head 13Y is mounted on an upper cover **11*a* of the color image forming apparatus 11. When the upper cover 11*a* is opened, the LED head 13Y moves away from the top of the printing mechanism 12Y**. This mechanism allows detachable mounting of the printing mechanism.

The cam shaft 22 is provided with a one-way bearing **212*a* attached to a gear 25. The gear 25 is driven by a motor gear 27 via a large gear 26*a* and a small gear 26*b* of a two-gear assembly 26. The gears 26*a* and 26*b* are secured together so that they always rotate together. The photosensitive drum 16 has a gear 16*a* mounted at its one longitudinal end. When the frame 24 is rotated about the projections 24*a*, the gear 16*a* moves into or out of a meshing engagement with the large gear 26*a*. The cam shaft 22, one-way bearing 22*a*, eccentric cam 23, gear 25, gears 26*a* and 26*b*, motor gear 27, and motor 28 constitute a positioning mechanism for the printing mechanism 12Y**.

The printing mechanism 12Y is usually positioned at its operative position as shown in FIG. 7 where the gear **26*a* engages the gear 16*a* and is driven in a direction shown by arrow A at a constant speed when the motor 28 runs in its forward direction. When the motor 28 runs in the forward direction, the gear 25 rotates but the cam shaft 22 and eccentric cam 23 will not rotate since the one-way bearing rotates freely without a load. A spring 23*a* is mounted between the eccentric cam 23 and the body of the image forming apparatus 11 and urges the eccentric cam 23 in a direction shown by arrow E so that a large-radius portion 23*b* of the eccentric cam 23 is oriented toward the spring 23*a***.

Figure 8:
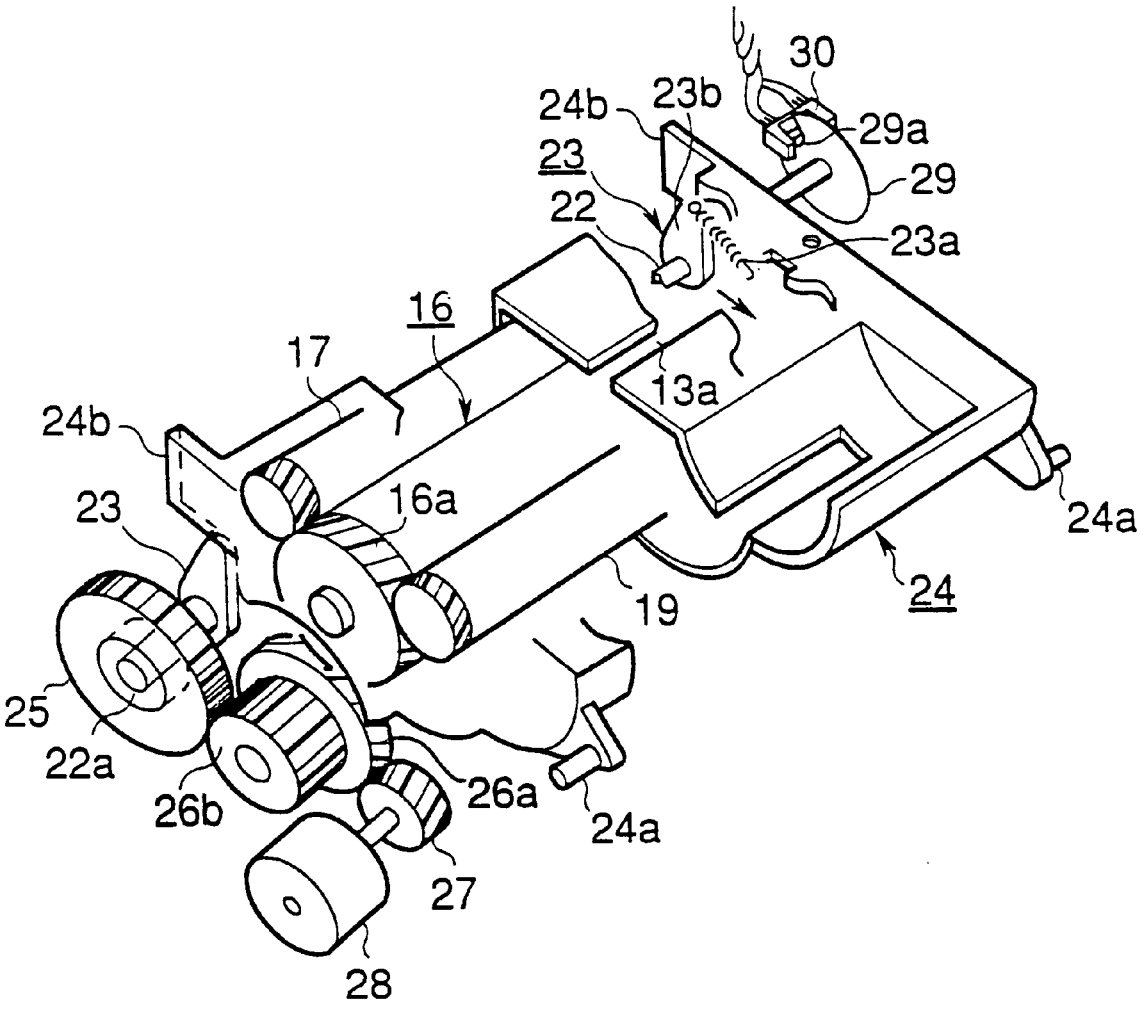
FIG. 8 is a perspective view of a printing mechanism positioned at its non-operative position.

FIG. 8 is a perspective view of a printing mechanism 12Y when positioned at its non-operative position. When the motor 28 runs in its reverse direction, the gear 25 and one-way bearing 22*a* interlock to drive the cam shaft 22 in rotation, so that the eccentric cams 23 rotate. At this time, as shown in FIG. 8, the printing mechanism 12Y is rotated clockwise about the projections 24*a* into the non-operative position where the gear 16*a* is out of engagement with the gear 26*a*.

A slit disc 29 is formed with a slit 29*a* therein and secured to a longitudinal end of the cam shaft 22, opposite to the gear 25. A photosensor 30 detects the slit 29*a* to determine the rotational position of the eccentric cam 23.

As shown in FIGS. 7 and 8, the frame 24 of the printing mechanism 12Y is formed with an opening 13*a* through which the LED head 13Y opposes the photosensitive drum 16 and illuminates the surface of the photosensitive drum 16. The opening 13*a* facilitates positioning of the LED head 13Y with respect to the printing mechanism 12Y.

Referring to FIGS. 5 and 6 again the endless belt or carrier 20 is in the form of an endless, continuously solid loop, made of a high resistance semiconductive plastic film material. The carrier belt 20 is disposed about a drive roller 31, driven roller 32, and tension roller 33. The electrical resistance of the carrier belt 20 is selected so that the carrier belt 20 sufficiently attracts the recording medium 21 and static electricity developed thereon is automatically neutralized when the recording medium 21 leaves the carrier belt 20.

The drive roller 31 is driven by a belt motor, not shown, to rotate in a direction shown by arrow F. The tension roller 33 is urged by a spring, not shown, in a direction shown by arrow G to apply a predetermined tension force to the carrier belt 20. An upper part 20*a* of the carrier belt 20 runs through the transferring areas of the first to fourth printing mechanisms P1–P4 and the lower part 20*b* runs around the tension roller 33 and cleaning blade 34.

The cleaning blade 34 is made of a flexible rubber material or a plastics material and scratches the residual toner off the surface of the carrier belt 20 into the toner tank 35.

A paper feeding mechanism 36 is disposed on the lower right-hand side of the color image forming apparatus 11 shown in FIG. 5. The paper feeding mechanism 36 includes a paper cassette, paper feeding mechanism, and registry rollers 45 located at the end of guides 43,44. The paper cassette includes a recording medium tray 37, push-up plate 38, and spring 39. The paper feeding mechanism includes a separator 40, spring 41, and paper pick-up roller 42. The spring 41 urges the paper separator 40 against the paper pick-up roller 42 so that the paper separator 40 is in pressure contact with the paper pick-up roller 42.

The spring 39 pushes up the recording medium 21 in the recording medium tray 37 so that the leading edge of recording medium 21 is in pressure contact with the paper pick-up roller 42. When the paper pick-up roller 42 rotates in a direction shown by arrow H, the separator 40 separates the top page of recording medium from the rest so as to feed the recording medium 21 one page at a time from the tray 37. Each page is guided in guides 43,44 and 46 and pulled in between the attraction roller 47 and carrier belt 20.

The attraction roller 47 is urged against the driven roller 32 with the carrier belt 20 sandwiched therebetween so as to charge and attract the recording medium 21 delivered from the paper feeding mechanism 36. For this purpose, the attraction roller 47 is made of a semiconductive rubber material having a high electrical resistance. The guide 46 is provided with a photosensor that detects the leading edge of the recording medium 21.

A neutralizing unit, not shown, is disposed to oppose the drive roller 31 with the carrier belt 20 between the drive roller 31 and the neutralizing unit. The neutralizing unit neutralizes the charges on the recording medium 21 transported by the carrier belt 20 after transferring a toner image, so that the recording medium 21 is separated smoothly from the carrier belt 20. A photosensor, not shown, is downstream of the neutralizing unit with respect to the direction in which the recording medium 21 is transported and detects the trailing end of the recording medium 21.

A fixing unit 48 is disposed downstream of the neutralizing unit and photosensor with respect to the direction of travel of the recording medium 21. The fixing unit 48 fixes the toner image of the respective colors which have been transferred onto the recording medium 21 during the travel of the recording medium 21 through the first to fourth printing mechanisms P1–P4. The fixing unit 48 includes a heat roller 49 for heating the toner image on the recording medium 21, and a pressure roller 50 for pressing the recording medium 21 against the heat roller 49.

The heat roller 49 includes a resilient material such as silicone rubber covering a core made of, for example, aluminum and a fluorocarbon resin covering the surface of the resilient material that prevents offset. The pressure roller 50 includes a resilient material such as silicone rubber covering a core made of aluminum. A thermistor, not shown, is disposed to oppose the heat roller 49. The thermistor detects the temperature of the heat roller 49 so that a heater in the heat roller 49 is controlled to turn on and off in accordance with the detected temperature. An offset preventing liquid may be supplied to the surface of the heat roller 49 by means of an oil roller or oil pad.

A paper exit 51 is downstream of the fixing unit 48 with respect to the direction of travel of the recording medium 21 and an exit stacker, not shown, is disposed outside of the paper exit 51. The printed recording medium 21 is discharged to the paper stacker through the paper exit 51.

While the LEDs 13Y, 13M, 13C, and 13K have be described for forming electrostatic latent images on the photosensitive drums 16, lasers or a liquid crystal shutter may also be used. Further, although the eccentric cam 23 have been described for use as a positioning mechanism for positioning the printing mechanisms, a rack and pinion mechanism may also be used. The paper feeding mechanism 36 may be placed beside the registry rollers 45 instead of mounting at a lower part of the color image forming apparatus 11, so that the recording medium 21 may be transported horizontally.

<Operation of the Image Forming Apparatus>

The operation or the color image forming apparatus 11 of the aforementioned construction will now be described.

Upon power-up, the main controller of the color image forming apparatus performs initialization and the heater in the heat roller 49 is energized so as to warm up the heat roller 49 to a predetermined temperature.

The thermistor opposing the heat roller 49 detects the temperature of the heat roller 49 so that the heater is turned on and off in accordance with the detected temperature.

If the virtual page 61 shown in FIG. 2 contains at least one non-empty block for each color, all of the printing mechanisms must be placed at their operative positions. For this purpose, the main controller outputs UP signals, causing the motor 28 to rotate so as to position the respective printing mechanisms 12Y, 12M, 12C, and 12K at their operative positions. Thus, the transfer rollers 14Y, 14M, 14C, and 14K move into pressure contact with the carrier belt 20. The belt motor drives the carrier belt 20 to run at substantially the same speed as the peripheral speed of the photosensitive drums 16. As a result, the toner images of the respective colors are formed on the corresponding photosensitive drums 16 and are then transferred to the recording medium 21.

If the image signal does not contain any one of the yellow, magenta, cyan, and black image signals, the corresponding printing mechanism is positioned at its non-operative position so that only the rest of the printing mechanisms are operated to form the corresponding toner images.

For example, if the image signal contains only empty blocks for yellow, the motor 28 of the first printing mechanism P1 runs in the reverse direction so that the one-way bearing 22*a* and the gear 25 interlock, thereby causing the cam shaft 22 and eccentric cams 23 to rotate. The eccentric cams 23 push up the projections 24*b* so that the printing mechanism 12Y is rotated clockwise about the projections 24*a* to the non-operative position, with the gear 16*a* moving out of engagement with the gear 26*a*.

When the eccentric cam 23 has rotated to a position where the large-radius portion 23*b* is substantially immediately over the shaft, the photosensor 30 detects the slit 29*a* and causes the motor 28 to stop. Then, the motor 28 is energized by a motor holding means, not shown, thereby holding the printing mechanism 12Y at the non-operative position. Thus, the eccentric cam 23 is held against the urging force of the spring 23*a* so that the printing mechanism 12Y is held at the non-operative position.

When returning the printing mechanism 12Y from the non-operative position to the operative position, the motor 28 of the first printing mechanism P1 is run in the forward direction. The one-way bearing 22*a* rotates freely without a load and therefore the rotation of the motor 28 is not transmitted to the eccentric cams 23.

As a result, the spring 23*a* pulls the cam shaft 22 so that the eccentric cam 23 is rotated gradually in the reverse direction till the large-radius portion 23*b* is oriented toward the spring 23*a*.

At the same time, the spring 17*a* urges the printing mechanism 12Y at the LED head 13Y so that the printing mechanism 12Y is rotated counterclockwise about the projections 24*a* to the operative position. When the frame 24 of the printing mechanism 12Y abuts a stopper provided on the body of the color image forming apparatus 11, the printing mechanism 12Y stops rotating about the projections 24*a*. Thus, the photosensitive drum 16 moves into pressure contact with the carrier belt 20 and the gear 16*a* moves into engagement with the gear 26*a*. Thus, the first printing mechanism P1 is ready for forming an yellow toner image.

Likewise, the printing mechanisms 12M, 12C, and 12K are positioned at their operative positions, respectively, when the motors 28 of the second to fourth printing mechanisms P2–P4 run in the forward direction, and are positioned at their non-operative positions when the motors 28 run in the reverse direction.

Thus, when only a toner image of a particular color is to be formed, the photosensitive drums 16 of the printing mechanisms of the other colors can be moved away from the carrier belt 20 and recording medium 21, preventing wear of the photosensitive drum 16 and carrier belt 20, as well as extending the useful lives of the photosensitive drums and carrier belt 20. In addition, toner of the printing mechanisms not in operation is prevented from deteriorating, thereby prolonging the life of the toner as well as improving image quality.

When the motors 28 run in the forward direction, the printing mechanisms 12Y, 12M, 12C, 12K are slowly moved with the aid of cams from the non-operative positions to operative positions; therefore the printing mechanisms 12Y, 12M, 12C and 12K receive no mechanical shock or impact.

When the motors 28 start to rotate in the reverse direction in order to raise the printing mechanisms to the non-operative position, the photosensitive drums 16 rotate slightly in the reverse direction. This slight reverse rotation of the photosensitive drum will not impose any adverse effect since the gear 16*a* quickly moves out of engagement with the gear 26*a*.

Second Embodiment

<Construction>

A second embodiment of the invention, which is an improvement of the first embodiment, will now be described.

Figure 9:
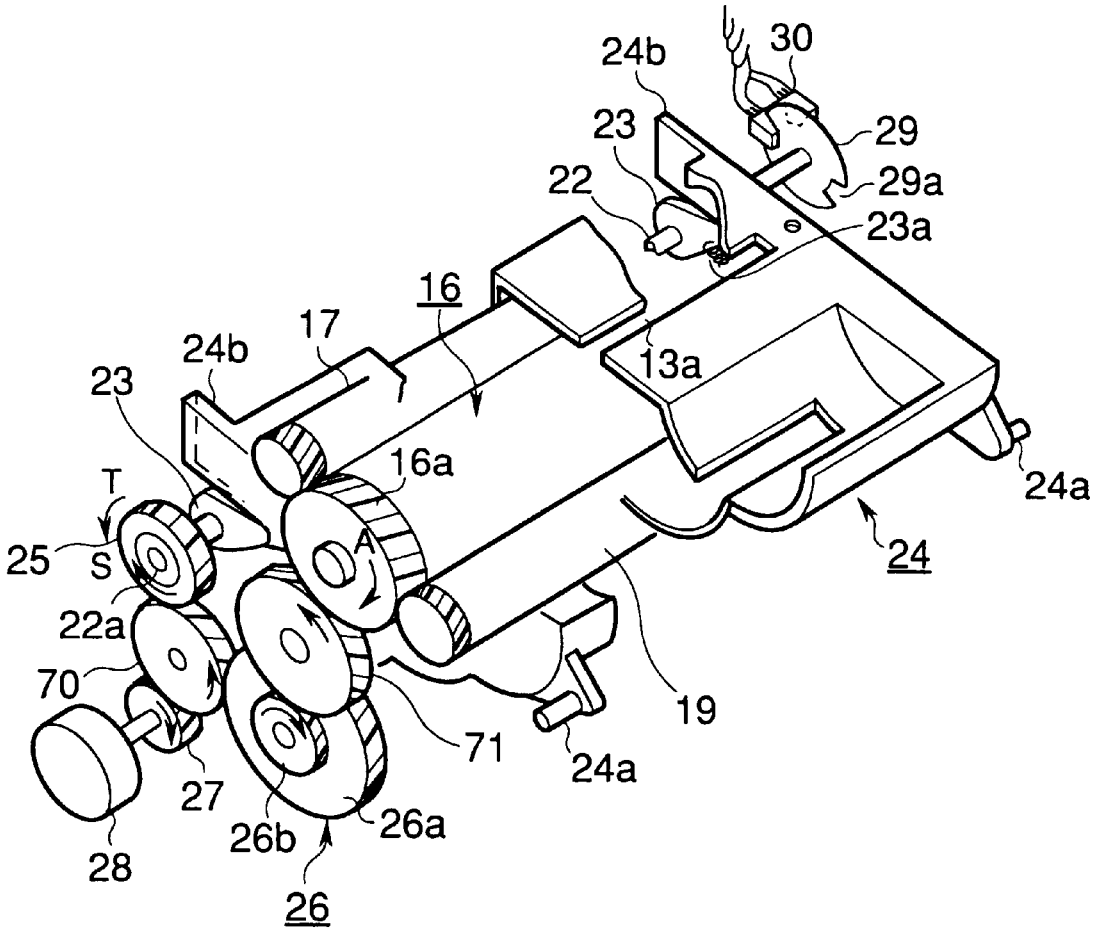
FIG. 9 is a perspective view of a printing mechanism positioned at its operative position.

FIG. 9 is a perspective view of a printing mechanism positioned at its operative position. Elements similar to those in the first embodiment have been given the same numerals and the description thereof is omitted.

The gear 25 is mounted to the one-way bearing 22*a* on one longitudinal end of the cam shaft 22. The gear 25 is in mesh with a gear 70 which in turn is in mesh with a motor gear 27 fixedly mounted to the shaft of the motor 28. The gear 70 is also in mesh with the large gear 26*a* of a two-gear assembly 26. The small gear 26*b* is in mesh with a gear 71 which in turn is in mesh with the gear 16*a* of the photosensitive drum 16. The cam shaft 22, one-way bearing 22*a*, eccentric cams 23, gears 25 and 70, motor gear 27, and motor 28 constitute a positioning mechanism for the printing mechanism. The gears 16*a*, 70, 71, large gear 26*a*, and small gear 26*b* constitute a gear train.

The one-way bearing 22*a* rotates freely when the gear 25 is rotated in a direction shown by arrow S, so that the rotation of the gear 25 is not transmitted to the cam shaft 22. The one-way bearing 22*a* and the gear 25 interlock when the gear 25 is rotated in a direction shown by arrow T, so that the rotation of the gear 25 is transmitted to the cam shaft 22 to cause the eccentric cams 23 to rotate in the direction shown by arrow T. When the gear 25 is rotated in a direction shown by arrow S, the photosensitive drum 16 rotates in a direction shown by arrow A.

The gear 16*a* is in mesh with the gears of the charging roller 17 and developing roller 19, so that the charging roller 17 and developing roller 19 rotate when the photosensitive drum 16 rotates.

<Operation>

The operation of the color image forming apparatus 11 according to the second embodiment will be described.

When the motor 28 runs in the reverse direction to drive the gear 25 in rotation in its direction shown by arrow T, the one-way bearing 22*a* and gear 25 interlock so that the cam shaft 22 and eccentric cam 23 rotate in the direction shown by arrow T. Thus, the eccentric cam 23 raises the projections 24*b* of the frame 24, with the printing mechanism 12Y being rotated clockwise about the projections 24*a* into the non-operative position.

As the gear 25 rotates in the direction shown by arrow T, the photosensitive drum 16 rotates slightly in the reverse direction though the amount of rotation is reduced by the small gear 26*b*. The reduction of rotation of the photosensitive drum 16 is very effective in suppressing the wear of the photosensitive drum 16 and carrier belt 20 due to friction therebetween.

When the motor 28 runs in the forward direction so as to drive the gear 25 to rotate in the direction shown by arrow S, the one-way bearing 22*a* freely rotates. Thus, the printing mechanism is rotated counterclockwise about the projections 24*a* into its operative position.

Third Embodiment

A third embodiment is an improvement of the first embodiment. The third embodiment differs from the first, embodiment in that the carrier belt runs in its reverse direction during the UP operation. The third embodiment will be described with reference to FIGS. 5 and 6.

During the UP operation of the printing mechanism, the belt motor may be caused to rotate in its reverse direction so that the carrier belt 20 runs in the direction shown by arrow C in FIGS. 5 and 6 at a speed substantially equal to the peripheral speed of the photosensitive drum 16 that rotates in the direction opposite to the direction shown by arrow A. Thus, the carrier belt 20 will not rub the surface of the photosensitive drum 16. As shown in FIG. 6, the movement of the carrier belt 20 in the direction shown by arrow C serves to scratch some amount of residual toner 80 adhering to the cleaning blade 34. The scratched residual toner 81 is carried on the carrier belt 20 past the cleaning blade 34. The residual toner 81 on the carrier belt 20 is then scratched off by the cleaning blade 34 when the carrier belt 20 again runs in the direction shown by arrow B, and is dropped into the toner tank 35. The forward and reverse movements of the carrier belt 20 provide smooth frictional engagement between the carrier belt 20 and cleaning blade 34, thereby preventing them from making screaming sounds. In addition, even if the edge of the cleaning blade 34 folds over when the carrier belt 20 runs in the direction shown by arrow 13, the short reverse movement of the carrier belt 20 will, allow the edge of the cleaning blade 34 to regain its original shape.

Fourth Embodiment

Figure 10:
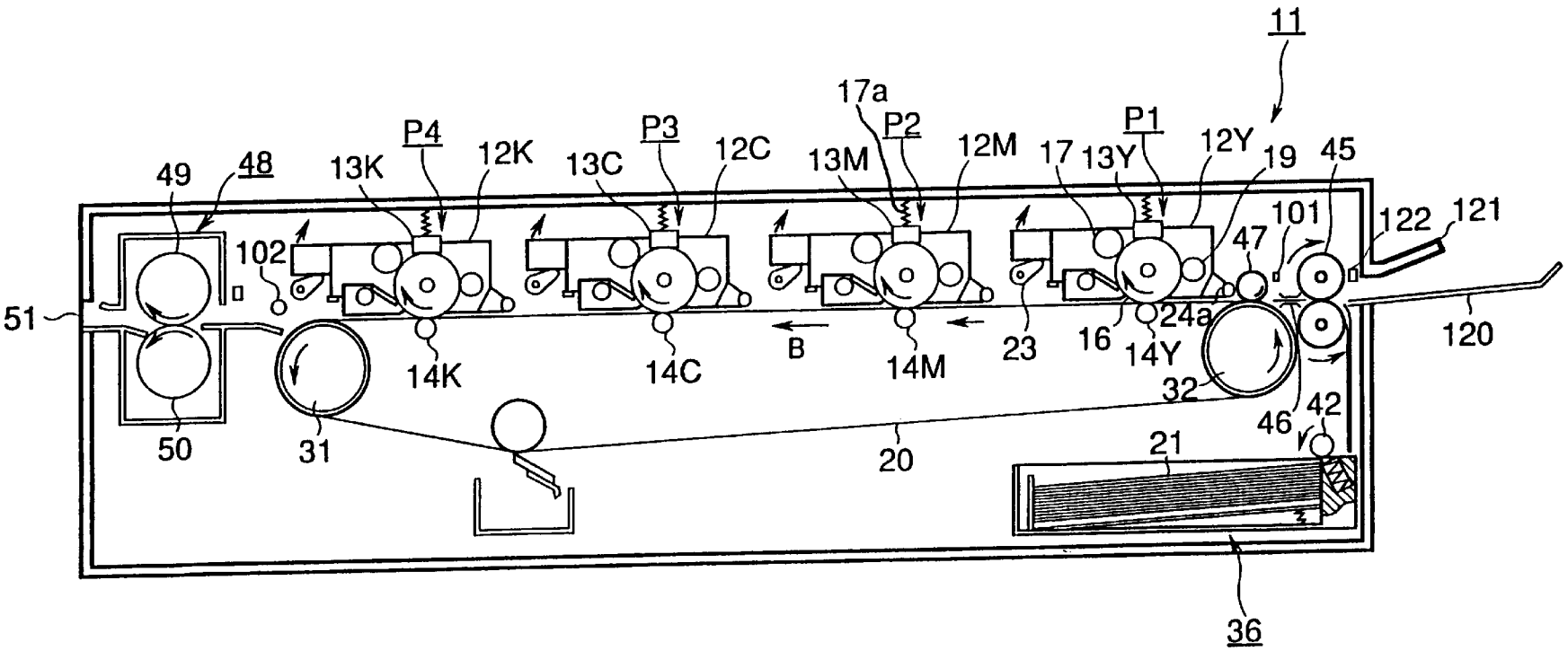
FIG. 10 illustrates a general construction of a color image forming apparatus according to a fourth embodiment.
Figure 11:
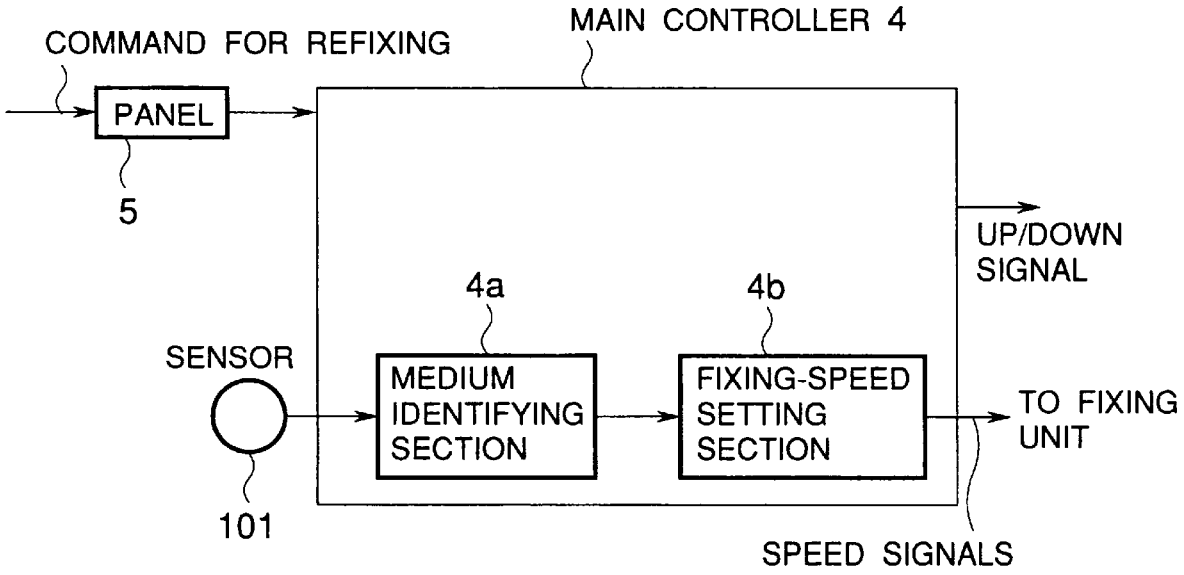
FIG. 11 is a block diagram illustrating a controller of the fourth embodiment.

FIG. 10 illustrates a general construction of a color image forming apparatus according to a fourth embodiment. FIG. 11 is a block diagram illustrating a controller of the fourth embodiment.

The fourth embodiment is directed to the operation of a color image forming apparatus in accordance with the UP/DOWN signals shown in FIG. 2 and kind of a recording medium.

<Construction>

Referring to FIGS. 10 and 11, when the user manually inserts the recording medium 21 from a manual insertion tray 120 through a guide 121, a photosensor 122 detects the recording medium 21 and sends a detection signal to the main controller. The recording may be fed from the built-in paper feeding mechanism 36. Upon receiving the detection signal, the main controller causes the printing mechanisms P1–P4 to be positioned at their operative and non-operative positions in accordance with the UP/DOWN signals. Then, the main controller causes the registry rollers 45, photosensitive drums 16, charging rollers 17, transfer rollers 14Y, 14M, 14C and 14K, drive roller 31, and heat roller 49 of the fixing unit 48 to rotate. The controller also applies a voltage to the attraction roller 47.

<Operation>

The registry rollers 45 rotate in the direction shown by arrows to feed the manually inserted recording medium 21 into the medium guide 46.

Then, a photosensor 101 detects the leading edge or the recording medium 21 so that a medium identifying section **4*a* identifies a kind or material of the recording medium 21 on the basis of the detection signal outputted from the photosensor 101 and a fixing-speed setting section 4*b* sets the fixing unit to a speed according to the kind or material of the recording medium 21. If the recording medium 21 is, for example, an OHP sheet, the fixing-speed setting section 4*b* sets the rotational speeds of the transfer rollers 14Y, 14M, 14C, and 14K, drive roller 31, registry rollers 45, and heat roller 49 to slightly lower values than when the recording medium 21** is ordinary paper. In other words, the fixing speed is decreased.

The recording medium 21 is pulled in between the attraction roller 47 and carrier belt 20. The recording medium 21 is then attracted by Coulomb force developed between the attraction roller 47 and driven roller 32. The carrier belt 20 transports the recording medium 21 in the direction shown by arrow B.

Then, in response to the DOWN signals, the motors 28 of the printing mechanisms rotate in the forward direction, so that the appropriate printing mechanisms are positioned at their operative positions and the photosensitive drums 16, charging rollers 17, and developing rollers 19 are driven in rotation. Therefore, toner images of the corresponding colors are formed on the photosensitive drums. The toner images are then transferred to the recording medium 21.

After a transferring operation, the recording medium 21 having the toner images thereon is neutralized by the neutralizing device 102 and passes through the fixing unit 48 where the colored toner images are fused on the recording medium 21 into a full color image. Thereafter, the recording medium 21 is delivered to the exit stacker, not shown, via the paper exit 51.

If some of the printing mechanisms are not at their operative positions, then only a limited number of layers of toner image are superimposed on the recording medium 21 and therefore the toner image is sufficiently fused. However, when all the printing mechanisms are at, their operative positions, four layers or toner may be superimposed in various areas in one page of the recording medium 21 and the toner cannot be sufficiently fused in some cases, causing poor fixing results. Good fixing results are obtained for ordinary paper but poor fixing can result, when the recording medium 21 is, for example, an OHP sheet.

Thus, the image forming apparatus 11 according to the fourth embodiment is capable of performing a refixing operation.

If the fixing result of a recording medium 21 is not sufficient, the user can instruct the refixing operation by inputting a command from the operating panel. Then, the user inserts the insufficiently fixed recording medium 21 again from the manual insertion tray 120. The photosensor 122 detects the recording medium 21 and sends a detection signal to the controller.

Upon receiving the detection signal, the controller causes the motors 28 to rotate in the reverse direction so that the printing mechanisms rotate clockwise about the projections **24*a* against the urging force of the springs 17*a*. When the photosensor 30 detects the slits 29*a* of the slit disc 29, the motors 28 are halted and the printing mechanisms 12Y, 12M, 1,2C, and 12K** are in their non-operative positions.

Then, with the motors 28 of all the printing mechanisms hatted, the main controller causes the transfer rollers 14Y, 14M, 14C, and 14K, drive roller 31, registry rollers 45, and heat roller 49 to rotate while also applying a voltage to the attraction roller 47.

Then, the recording medium 21 is attracted to the carrier belt 20 which in turn transports the recording medium 21 toward the fixing unit 48. The photosensitive drums 16 are stationary and are positioned away from the carrier belt 20 so that toner images of any colors are not transferred to the recording medium 21.

The recording medium 21 passes through the transferring areas of the first to fourth printing mechanism P1–P4, is neutralized by the neutralizing device 102, and then passes to the fixing unit 48.

The recording medium 21 is pulled in between the heat, roller 49 and pressure roller 50 in pressure contact with the heat roller 49, thereby being subjected to a refixing operation. The recording medium 21 is discharged to the exit stacker through the paper exit 51.

When refixing, the recording medium 21 need not be loaded into the paper feeding mechanism 36 but simply inserted into the manual insertion tray 120. This simplifies the refixing operation.

For a refixing operation of the recording medium 21, the user inputs a command for refixing from an operating panel 5 using a setting key, and then the user inserts the insufficiently fixed recording medium 21 into the image forming apparatus 11. In response to the command inputted from the operating panel 5, the controller sends UP signals to all the printing mechanism P1–P4. The recording medium is then transported by the carrier belt 20 to the fixing unit 48 where the recording medium 21 is again subjected to a fixing operation. A setting key may be provided which sets the number of pages of recording medium 21 that needs to be fixed again. Further, the number of pages may be specified from the external host computer.

Fifth Embodiment

Figure 12:
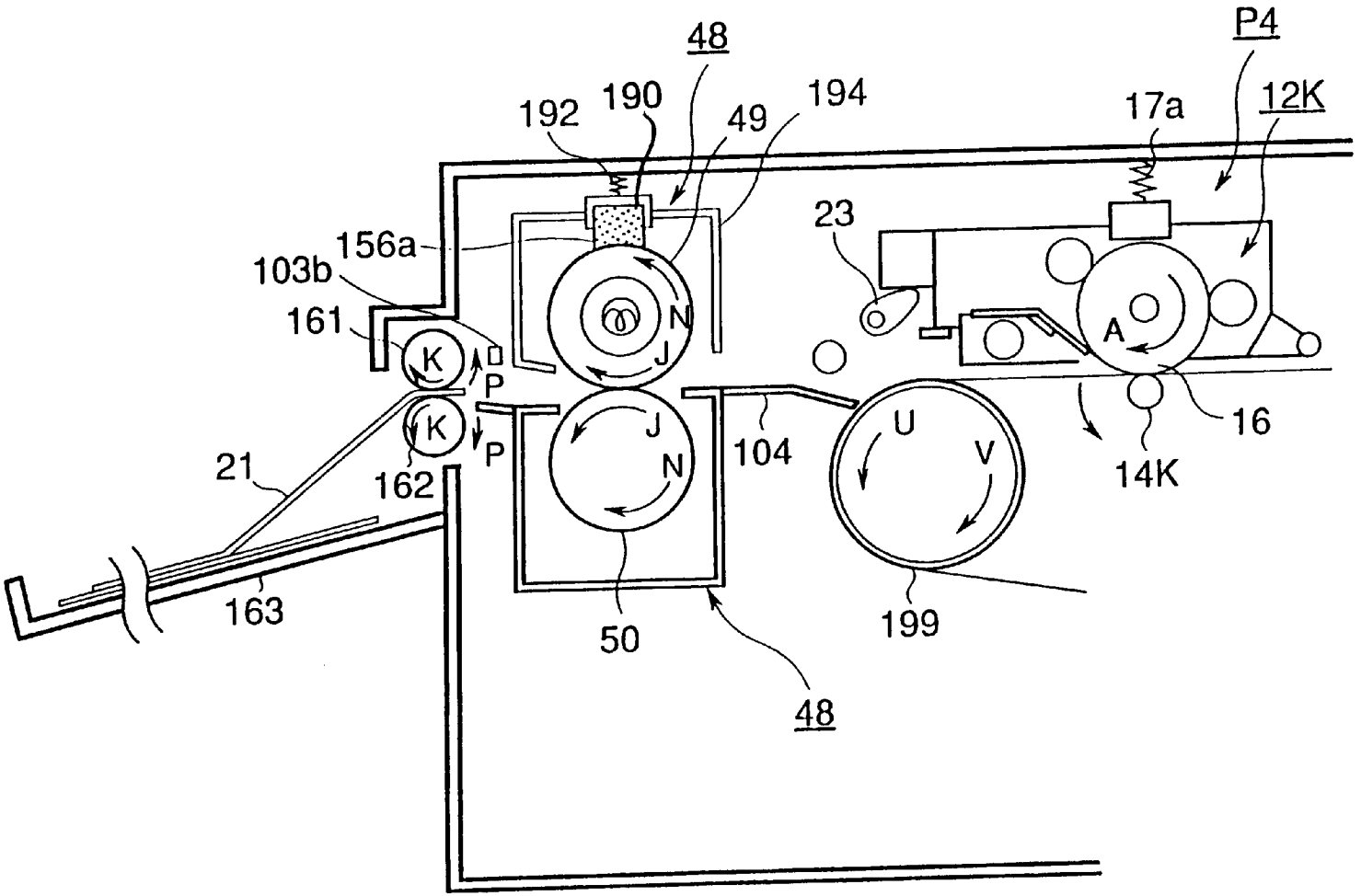
FIG. 12 is an enlarged side view of a relevant portion of a fifth embodiment.
Figure 13:
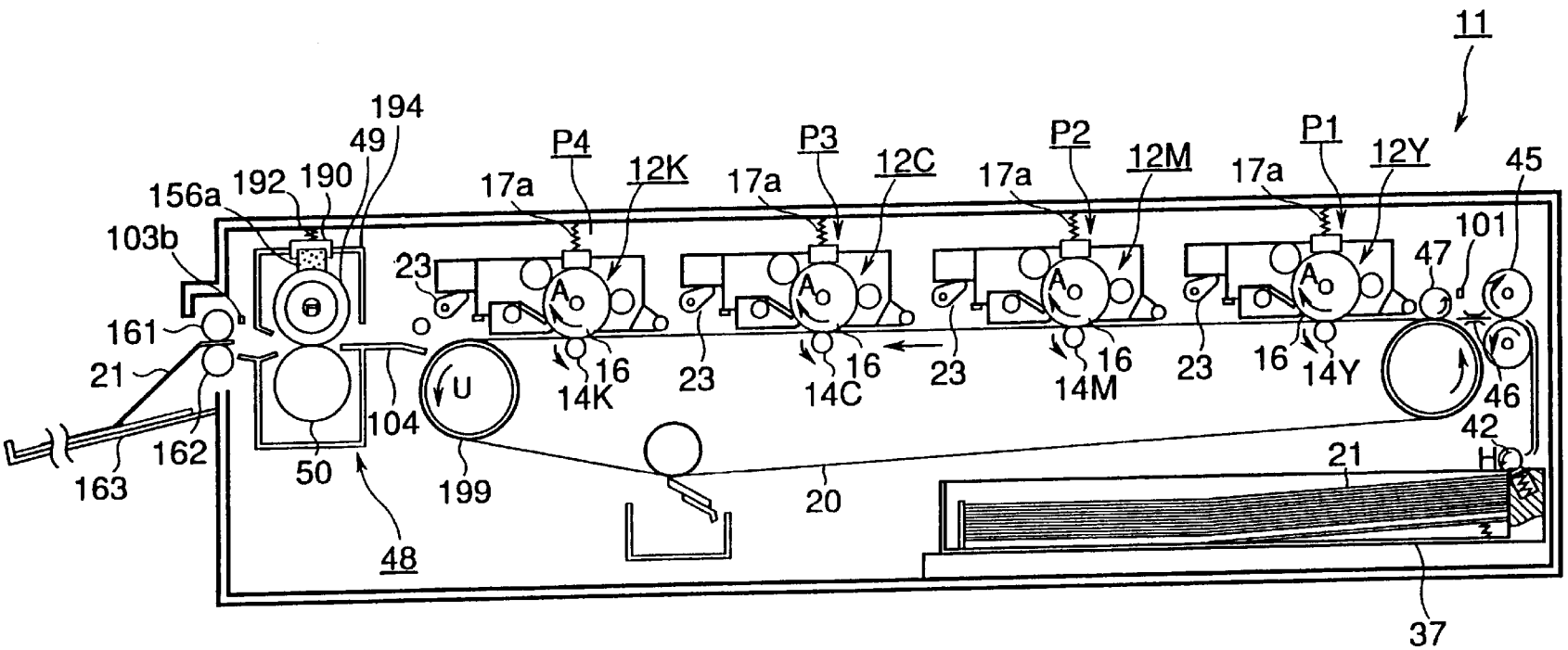
FIGS. 13 and 14 illustrate the operation of a color image forming apparatus according to the fifth embodiment.
Figure 14:
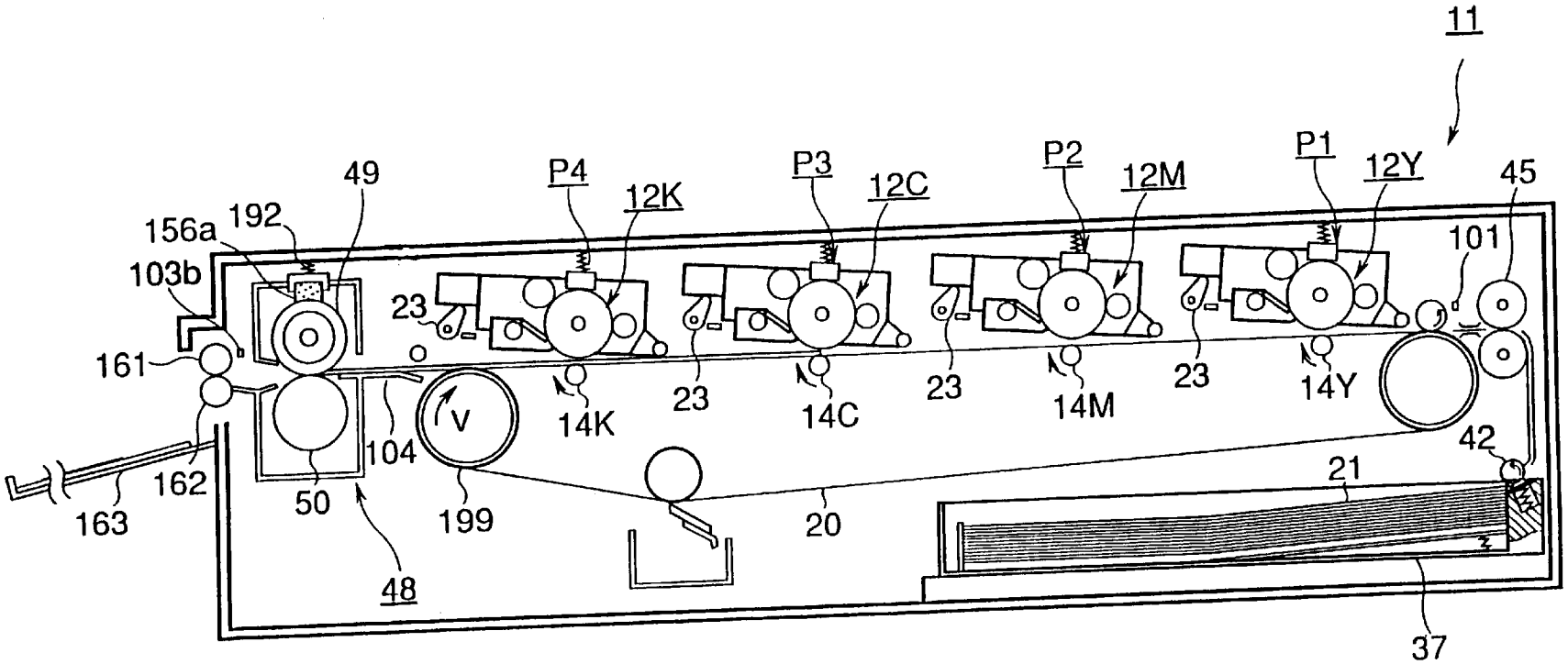
Figure 15:
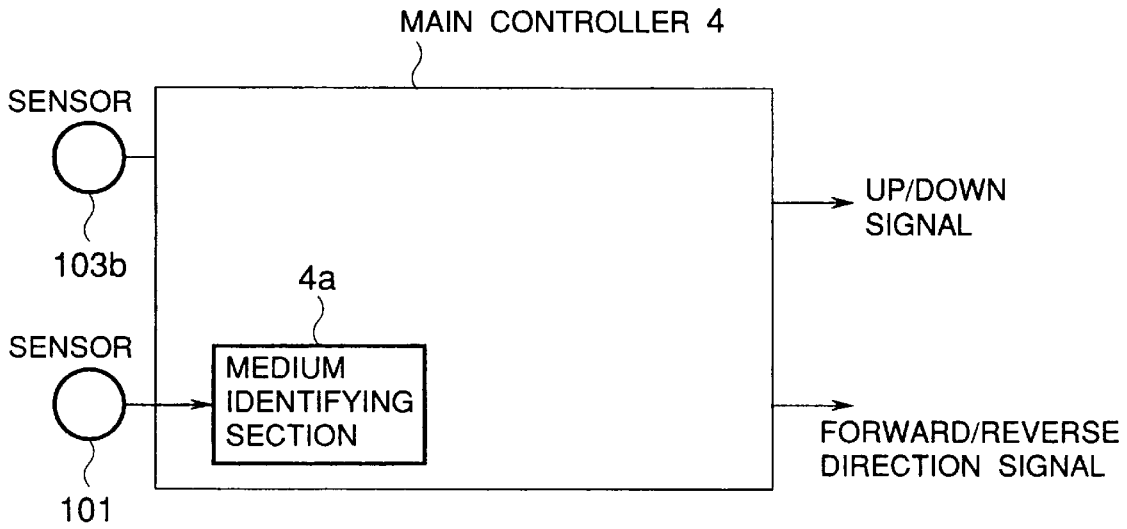
FIG. 15 is a block diagram illustrating a controller of the fifth embodiment.

FIG. 12 is an enlarged side view of a relevant portion of a fifth embodiment. FIGS. 13 and 14 illustrate the operation of a color image forming apparatus according to the fifth embodiment. FIG. 15 is a block diagram illustrating a controller of the fifth embodiment.

<Construction>

Referring to FIG. 13, the printing mechanisms 12Y, 12M, 12C, and 12K are adapted to be selectively positioned at their operative positions and non-operative positions. A first motor, not shown, drives the paper pick-up roller 42 in rotation in a direction shown by arrow H. A second motor, not shown, drives the registry rollers 45 in the directions shown by arrows. A third motor, not shown, selectively positions the respective printing mechanisms at their operative positions and non-operative positions and causes the printing mechanisms at the operative positions to operate. A fourth motor causes the drive roller 199 to rotate in directions shown by arrows U or V, and causes the transfer rollers 14Y, 14M, 14C, and 14K and attraction roller 47 to rotate clockwise or counterclockwise. As shown in FIG. 12, a fifth motor, not shown, causes the heat roller 49, pressure roller 50, and discharge rollers 161 and 162 to rotate in directions shown by arrows J and K or by arrows N and P, respectively. The fourth and fifth motors are energized independently of the first, second, and third motors.

A support member 190 supports a felt block 156*a* in such a way that the felt block 156*a* is in contact with the heat roller 49. The support member 190 extends in a direction perpendicular to the page of FIG. 12 and is fitted into a longitudinally extending opening formed longitudinally in the upper case 194. The support member 190 is urged by the spring 192 so that the felt block 156*a* is in pressure contact with the heat, roller 49.

<Operation>

The operation of the aforementioned color image forming apparatus 11 will be described.

Upon power-up, the main controller of the color image forming apparatus 11 performs initialization and energizes the heater in the heat roller 49 to set, the heat roller 49 to a predetermined temperature.

When the heat roller 49 reaches the predetermined temperature, the controller causes the first motor to drive the paper pick-up roller 42, thereby feeding the recording medium 21 held in the paper tray 37 one page at a time.

The main controller causes the second and third motors to rotate so that the printing mechanisms 12Y, 12M, 12C, and 12K are positioned appropriately at their operative positions or non-operative positions, the drive roller 199 rotates in the direction shown by arrow U, and the transfer rollers 14Y, 14M, 14C, and 14K, and attraction roller 47 rotate in the directions shown by arrows in FIG. 13 to run the carrier belt 20.

The registry rollers 45 are rotated in the directions shown by arrows shown in FIG. 13 and the heat roller 49, pressure roller 50, discharge rollers 161 and 162 in the directions shown by arrows 3 and K.

As a result, the recording medium 21 is guided through the guide 46 and the leading edge of the recording medium 20 reaches the contact between the attraction roller 47 and carrier belt 20 where the recording medium 20 is attracted to the carrier belt 20 with the aid of Coulomb force developed by the attraction roller 47. The carrier belt 20 transports the recording medium 21 with the recording medium 21 attracted thereto.

The printing mechanisms at their operative positions produce toner images of the corresponding colors and the toner images are transferred to the recording medium 21 when the recording medium 21 passes through the transferring areas between the respective photosensitive drums 16 and the transfer rollers.

In this manner, the toner images of the respective colors are transferred one over the other on the recording medium to form a color image. Thereafter, the recording medium 21 separates from the upper surface of the carrier belt, 20, and then travels through the guide 104 to the fixing unit 48.

If the medium identifying section 4*a* shown in FIG. 15 identifies that the recording medium 21 is ordinary paper, the recording medium 21 having been fixed by the fixing unit 48 travels to the discharge rollers 161 and 162 which discharge the recording medium 21 to an exit stacker 163.

If the medium identifying section identifies that the recording medium 21 is an OHP sheet, the main controller causes the fifth motor to stop as shown in FIGS. 12 and 13 immediately after the photosensor 103*b* detects the trailing end of the recording medium 21 after the first fixing operation. It is to be noted that the trailing end of the recording medium 21 remains caught between the discharge rollers 161 and 162.

Then, the main controller outputs a reverse direction signal to the fifth motor, causing the third motor to rotate in the reverse direction so that the respective printing mechanisms move to their non-operative positions. The main controller also causes the fourth and fifth motors to rotate in the reverse directions so that the discharge rollers 161 and 162 rotate in the directions shown by arrow P, the heat roller 49 and pressure roller 50 rotate in the directions shown by arrow N, the transfer rollers 14Y, 14M, 14C, and 14K and attraction roller 47 rotate in the direction shown by arrows in FIG. 12, and the drive roller 199 rotates in the direction shown by arrow V. Thus, the recording medium 21 travels in the reverse direction, completing the second fixing operation.

The photosensor 103*b* detects the trailing end of the recording medium 21 when the trailing end of the recording medium 21 has traveled to a position at which the trailing end is pulled in between the heat, roller 49 and pressure roller 50, the main controller outputs a forward direction signal to the fourth and fifth motors, causing the fourth and fifth motors to rotate in the forward directions so that the discharge rollers 161 and 162 rotate in the directions shown by arrow K, the heat roller 49 and pressure roller 50 rotate in the directions shown by arrow J, the transfer rollers 14Y, 14M, 14C, and 14K rotate in the directions shown in FIG. 13, and the drive roller 199 rotates in the direction shown by arrow U. Thus, the recording medium 21 travels in the forward direction, completing the third fixing operation.

In this embodiment, when a refixing operation is to be performed, the insufficiently fixed recording medium 21 need not be loaded into the paper tray 37 but, is passed through the fixing unit 48 back and forth. This simplifies the refixing operation.

The printing mechanisms 12Y, 12M, 12C, and 12K are at their non-operative positions while the second fixing operation is being performed. Therefore, the toner images of the respective colors are not transferred to the recording medium 21 and the recording medium 21 simply passes through the transferring areas.

Sixth Embodiment

In forming a color image, toner images of yellow, magenta, cyan, and black are transferred to the recording medium 21 one toner image over the other. Therefore, a maximum of four layers of toner image are superimposed. The larger the number of layers of toner, the more difficult it is to sufficiently fuse the toner of the respective colors, impairing print quality.

Another problem with color printing is that poorly fused layers of toner superimposed on an OHP (overhead projector) sheet wilt have a rough surface which causes diffuse reflection of the light transmitted therethrough. Diffuse reflection is a source of poor quality of a projected image. In order to ensure effective projection of transmitted light, the toner images must, be sufficiently fixed by supplying a sufficient amount of heat to the heat roller 49. Supplying increased heat not only requires a heater that consumes greater electric power but. takes a longer time till the temperature of the heat roller 49 reaches a predetermined value. This leads to a longer start-up time of the image forming apparatus.

With a tandem type color image forming apparatus 11, the recording speed is primarily determined by the fixing speed of the fixing unit 48 irrespective of whether a color image is formed or a monochrome image is formed. This indicates that the speed of a monochrome printing operation is confined to that of a color printing operation.

Therefore, a sixth embodiment is directed to an image forming apparatus where the printing speed is varied in accordance with the kind or recording medium and the number of layers of toner to be printed on the recording medium, thereby providing as fast a printing operation as possible. The sixth embodiment allows sufficient fixing of a colored image on an OHP sheet, while also providing for a high speed monochrome printing operation.

<Construction>

Figure 16:
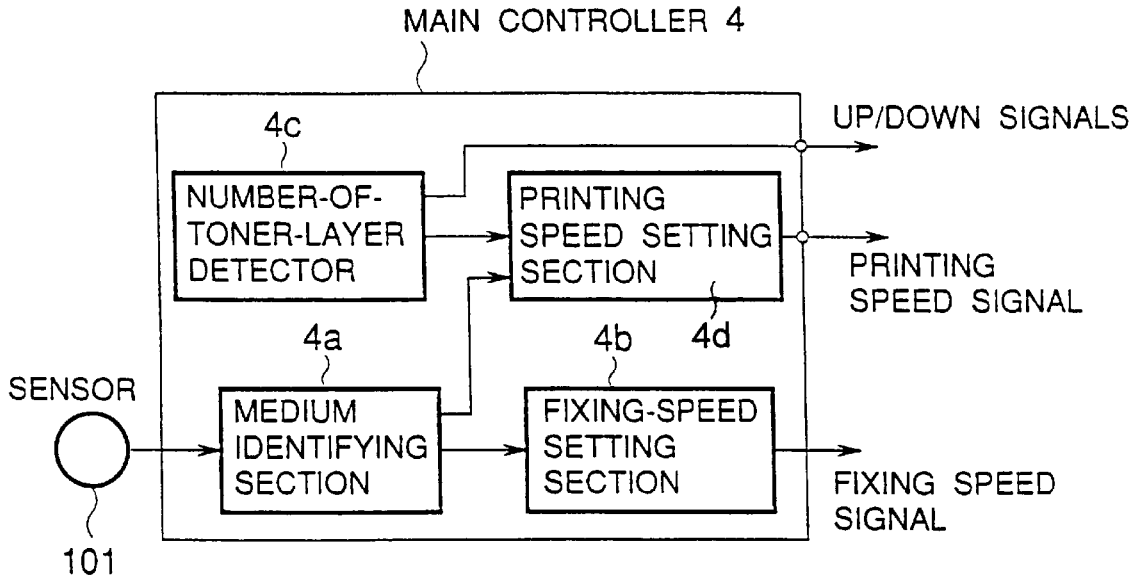
FIG. 16 is a block diagram of a relevant portion of the controller of the sixth embodiment.
Figure 17:
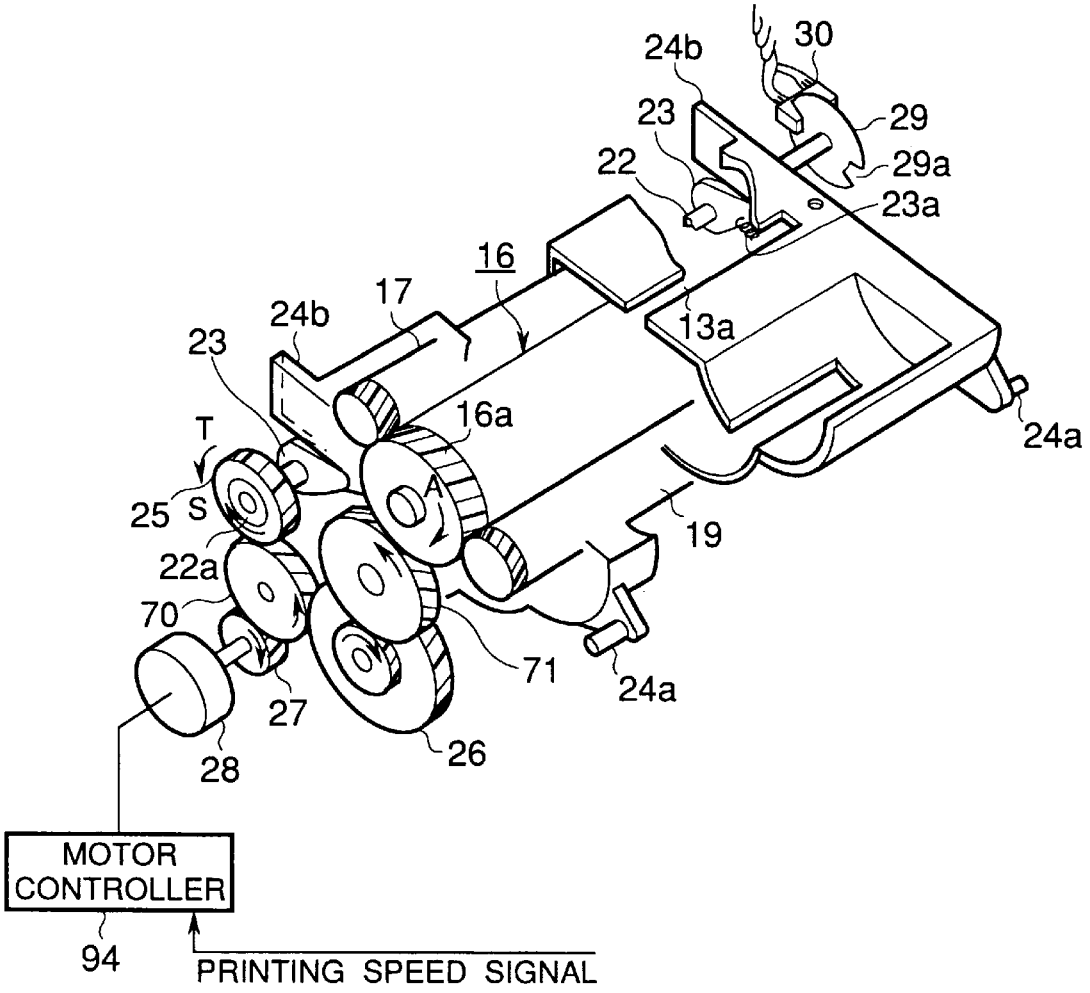
FIG. 17 is a perspective view of a printing mechanism according to the sixth embodiment.

FIG. 16 is a block diagram of a relevant portion of the controller of the sixth embodiment. FIG. 17 is a perspective view of a printing mechanism according to the sixth embodiment. Elements corresponding to those in the second embodiment (FIG. 9) have been given the same reference numerals and description thereof is omitted.

Referring to FIG. 16, a photosensor 101 provided in the guide 46 detects the leading edge of a recording medium 21. A medium identifying section 4*a* identifies the kind or material of the recording medium 21 on the basis of the output of the photosensor 101. A number-of-toner-layer detector 4*c* detects the number or toner layers or the number of printing mechanisms at their operative positions. A printing speed setting section 4*d* sets the printing speed of the image forming apparatus 11 in accordance with the outputs of the number-of-toner-layer detector 4*c* and medium identifying section 4*a*. Then, the main controller outputs speed control signals to the belt motor, fixing unit, transfer rollers, and motor controllers 94 of the printing mechanisms at their operative positions. A fixing speed setting section 4*b* determines the fixing speed in accordance with the kind of recording medium.

If the image signal contains all of yellow image signal, magenta image signal, cyan image signal, and black image signal, then all the printing mechanisms 12Y, 12M, 12C, and 12K are placed at their operative positions, so that the respective photosensitive drums 16 and transfer rollers 14Y, 14M, 14C, and 14K are in pressure contact with the carrier belt 20. The motors 28 are driven in rotation so that each of the respective printing mechanisms 12Y, 12M, 12C, and 12K forms a toner image of a corresponding color. The belt driving motor, not shown, rotates to cause the carrier belt 20 to run at the same speed as the peripheral speed of the photosensitive drums 16 of the printing mechanisms, so that the recording medium 21 is transported through the transferring areas where toner images of corresponding colors are transferred to the recording medium 21. The cam shaft 22, one-way bearing 22*a*, eccentric cam 23, gear 25 and 70, motor gear 27, and motor 28 constitute a positioning mechanism for the printing mechanism.

If the image signal does not contain at least one of yellow image signal, magenta image signal, cyan image signal, and black image signal, then the main controller outputs the UP signal so as to move a printing mechanism corresponding to the missing image signal to the non-operative position.

When forming a monochrome image, only a black toner layer is required and therefore a load on the fixing unit 48 is very low.

<Operation>

When forming a color image of red (yellow plus cyan), green (yellow plus cyan), or blue (magenta plus cyan), two printing mechanisms are operated to form a toner image of two layers.

When forming a color image using three primary colors, three printing mechanisms operate to form a toner image of three layers. If black is added to this color image, the toner image will be of four layers.

If the fixing unit is set to 150° C. and a fixing speed of 4 PPM (page per minute) is required for completely fixing the colored toner image of four layers on a sheet of recording medium, then the required fixing speed is 5 PPM for a three-layer toner image, 6 PPM for a two-layer toner image, and 8 PPM for a single-layer toner image. Thus, the smaller the number of toner layers, the faster the recording speed.

When forming a monochrome image on a sheet of recording medium with the fixing unit maintained at 150° C., the motor controller 94 causes the motors 28 of the respective printing mechanisms 12Y, 12C, and 12M to rotate in the reverse direction so that the gear 25 rotates in the direction shown by arrow T. Thus, the one-way bearing 22*a* and gear 25 interlock so that the cam shaft 22 and eccentric cam 23 are rotated in the direction shown by arrow T. The eccentric cams 23 raise the frame 24 at the projection 24*b* so that the printing mechanisms 12Y, 12M, and 12C are rotated clockwise about the projections 24*a* into their non-operative positions.

When the motor controller 94 causes the motor 28 of the printing mechanism 12K to rotate in the forward direction, the gear 25 rotates in the direction shown by arrow S, the one-way bearing 22*a* freely rotates without a load.

The motor controller 94 drives the photosensitive drum 16 of the printing mechanism 12K, charging roller 17, developing roller 19, transfer roller 14K, drive roller 31, registry rollers 45, and heat roller 49 in rotation at speeds corresponding to a fixing speed of 8 PPM.

For this purpose, a number-of-toner-layer detector 4*c* detects the number of toner layers or printing mechanisms that have been at the operative positions, and sets the recording speed of the image forming apparatus 11 in accordance with the number of toner layers.

When forming a two-layer color image on the ordinary paper with the fixing unit maintained at 150° C., the main controller causes the motor controller 94 to place the two corresponding printing mechanisms at their operative positions and then causes the photosensitive drums 16, charging rollers 17, developing rollers 19, transfer rollers, drive roller 31, registry rollers 45, and heat roller 49 to rotate at speeds corresponding to 6 PPM.

When forming a three-layer color image on the ordinary paper with the fixing unit maintained at 150° C., the main controller causes the motor controller 94 to set the three corresponding printing mechanisms at their operative positions and then causes the photosensitive drums 16, charging rollers 17, developing rollers 19, transfer rollers, drive roller 31, registry rollers 45, and heat roller 49 to rotate at speeds corresponding to 5 PPM.

When forming a four-layer color image on the ordinary paper with the fixing unit maintained at 150° C., the main controller sets the four corresponding printing mechanisms at their operative positions and then causes the photosensitive drums 16, charging rollers 17, developing rollers 19, transfer rollers, drive roller 31, registry rollers 45, and heat roller 49 to rotate at speeds corresponding to 4 PPM.

As described above, the recording speed of the image forming apparatus 11 is changed in accordance with the number of toner layers i.e., the number of printing mechanisms that have been positioned at their operative positions. Therefore, toner of the respective colors can be sufficiently fused to improve print quality, while providing high speed monochrome printing.

If the recording medium 21 is an OHP sheet, the main controller outputs a fixing speed signal to set the fixing unit 48 to a temperature about 15° C. higher than the aforementioned operating temperature (150° C.).

This elevated temperature allows the toner layers on an OHP sheet to fuse sufficiently, yielding sufficient projection or the light transmitted through the OHP. A photosensor, not shown, disposed in the guide 46 detects whether the recording medium 21 is an OHP sheet or not.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A color image forming apparatus, comprising:

a carrier belt, said carrier belt transporting a recording medium placed thereon;

a controller, said controller checking each page of print data to determine whether any one of a predetermined plurality of colors is missing in the page, said controller outputting a signal indicative of a missing color in the page;

a plurality of printing mechanisms, said printing mechanisms printing images of different colors on the recording medium, each printing mechanism printing an image of a corresponding color, each said printing mechanism being adapted to move into an operative position where a part of the printing mechanism is in contact with said carrier belt to print the image on the recording medium and into a non-operative position where the part of the printing mechanism is not in contact with said carrier belt so as to not print the image on the recording medium; and a plurality of positioning mechanisms, said positioning mechanisms moving said printing mechanisms to their operative positions or non-operative positions, each of said positioning mechanisms moving the corresponding printing mechanism to its non-operative position if said signal indicates that the corresponding color is missing and to its operative if said signal indicates that the corresponding color is not missing.

2. The color image forming apparatus of claim 1, wherein each of said positioning mechanisms includes:

a cam shaft having a cam mounted thereto, said cam shaft rotating to a first position so that the cam moves said printing mechanism to the operative position, said cam shaft rotating to a second position so that the cam moves said printing mechanism to the non-operative position;

a one-way bearing mounted to said cam shaft and being adapted to rotate in a first direction so that said cam shaft rotates to the first position and to rotate in a second direction opposite to the first direction so that said cam shaft rotates to the second position; and a gear mounted to said one-way bearing, said one-way bearing and said gear interlocking to rotate the cam shaft in the second direction when said gear rotates in the first direction, and not interlocking when said gear rotates in the first direction.

3. The color image forming apparatus of claim 2, wherein each of said positioning mechanisms further includes an urging member which urges said cam shaft toward the first position.

4. The color image forming apparatus of claim 2, wherein each of said positioning mechanisms further includes;

a disc mounted to said cam shaft and having a radial slit formed therein; and a photosensor detecting the slit when said cam shaft rotates to the second position.

5. The color image forming apparatus of claim 2, wherein said gear is drivingly connected to said printing mechanism so that a first rotational speed of said gear is transmitted to said printing mechanism when said cam shaft rotates in the second direction and a second rotational speed of said gear is transmitted to said printing mechanism when said cam shaft rotates in the first direction, the first rotational speed being higher than the second rotational speed.

6. The color image forming apparatus of claim 1, wherein said controller further includes:

a medium identifying section which identifies a material of the recording medium; and a fixing-speed setting section which sets a speed of a fixing operation according to the material of the recording medium.

7. The color image forming apparatus of claim 6, further including a medium inserting port through which the recording medium discharged from a recording apparatus is again inserted;

wherein said controller further includes:

a command inputting device through which an operator inputs a command for performing the fixing operation on the recording medium discharged from the recording apparatus.

8. The color image forming apparatus according to claim 1, wherein each of said printing mechanisms includes a photosensitive drum, said part of said printing mechanism being a surface of the photosensitive drum, the photosensitive drum rotating in a reverse direction when said printing mechanism is being moved from the operative position to the non-operative position, wherein said controller causes said carrier belt to run in a reverse direction when said printing mechanism is being moved from the operative position to the non-operative position, said carrier belt running at a speed substantially equal to a peripheral speed of said part of said printing mechanism in contact with said carrier belt till said printing mechanism has moved out of contact engagement with said carrier belt.

9. The color image forming apparatus according to claim 1, wherein said controller further includes:

a number-of-toner-layer detector which detects a number of layers of a colored toner image which should be printed on one page of said recording medium; and a printing-speed setting section which sets a speed of a fixing operation according to the number of layers of toner.

10. The color image forming apparatus according to claim 9, wherein said printing-speed setting section sets a speed of the fixing operation according to the number of layers of toner and the material of said recording medium.

11. The color image forming apparatus of claim 1, further including:

a fixing station; and a pair of rollers transporting the recording medium therebetween to discharge the recording medium after the recording medium has been fixed by said fixing station, said pair of rollers being adapted to selectively rotate in a forward direction and in a reverse direction;

wherein said controller further includes:

a medium identifying section for identifying a material of the recording medium;

wherein if said medium identifying section identifies that the recording medium is not of a predetermined material, said controller performs a first mode of fixing in which the controller causes said pair of rollers to rotate in the forward direction so that the recording medium passes in a first direction through said fixing station, the recording medium being fixed by the fixing station for a first fixing operation; and if said medium identifying section identifies that the recording medium is of a predetermined material, said controller performs a second mode of fixing in which, after the first mode of fixing, the controller causes said pair of rollers to rotate in the reverse direction opposite to the first direction so that the recording medium passes through the fixing station, the recording medium being fixed by the fixing station for a second fixing operation, and finally the controller causes said pair of rollers to rotate in the forward direction so that the recording medium travels in the direction away from said fixing station, the recording medium being fixed by the fixing station for a third fixing operation.

12. The color image forming apparatus of claim 1, further including:

a detector arranged between a fixing station and a pair of rollers and detecting a trailing end of the recording medium when the recording medium passes by;

wherein said controller causes said pair of rollers to switch its direction of rotation when said detector detects the trailing end of the recording medium in a second mode of operation.

* * * * *